US012376628B2

(12) United States Patent
Owenson et al.

(10) Patent No.: US 12,376,628 B2
(45) Date of Patent: Aug. 5, 2025

(54) APPAREL FASTENER

(71) Applicant: NIKE, Inc., Beaverton, OR (US)

(72) Inventors: Andrew Owenson, Beaverton, OR (US); Andrew A. Owings, Portland, OR (US); Kyle Schepke, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 18/217,974

(22) Filed: Jul. 3, 2023

(65) Prior Publication Data

US 2024/0008560 A1 Jan. 11, 2024

Related U.S. Application Data

(60) Provisional application No. 63/358,414, filed on Jul. 5, 2022.

(51) Int. Cl.
*A41C 3/00* (2006.01)

(52) U.S. Cl.
CPC ..... *A41C 3/0028* (2013.01)

(58) Field of Classification Search
None
See application file for complete search history.

(56) References Cited

U.S. PATENT DOCUMENTS 6,513,209 B1 2/2003 Portzline
9,345,274 B1 * 5/2016 Prill ..... A41D 1/215
2011/0099774 A1 5/2011 Pontaoe
2013/0065486 A1 * 3/2013 Hansen ..... A41C 3/0064 450/59
2018/0352884 A1 * 12/2018 Vanos ..... A41F 1/006
2023/0069762 A1 * 3/2023 Kim ..... B60J 1/2086
2023/0126308 A1 * 4/2023 Casillas ..... A41C 3/0028 450/36
2024/0008560 A1 * 1/2024 Owenson ..... A41C 3/0028

FOREIGN PATENT DOCUMENTS

DE 20210029 U1 8/2002

OTHER PUBLICATIONS

International Search Report and Written Opinion received for PCT Patent Application No. PCT/US2023/026927, mailed on Sep. 18, 2023, 16 pages.

* cited by examiner

*Primary Examiner* — Gloria M Hale
(74) *Attorney, Agent, or Firm* — SHOOK, HARDY & BACON L.L.P.

(57) ABSTRACT

This disclosure relates to a fastener that can be used with various apparel and that can be easier to operate and can be less likely to create discomfort to a wearer. In at least some examples, the fastener includes a hook, which can be connected to a first portion of the article, and a receiver, which can be connected to a second portion of the article. The hook can be releasably connected to the receiver to selectively secure the first portion of the article to the second portion of the article. The receiver can include various elements, and in one example, the receiver includes a slot that can receive, at various angles and orientations, a bend of the hook. In addition, receiver can include a cross bar (e.g., anchor bar) that mates with the bend of the hook to retain the hook in a secure position.

7 Claims, 14 Drawing Sheets

APPAREL FASTENER

CROSS-REFERENCE TO RELATED APPLICATIONS

This application claims the priority benefit of U.S. Provisional Patent Application 63/358,414 (filed Jul. 5, 2022), which is incorporated herein by reference in its entirety.

BACKGROUND

Fasteners are used in various garments (e.g., clothing, belts, footwear, etc.) and equipment (e.g., backpacks, duffle bags, etc.) to connect two or more portions together. For example, fasteners can be used to connect portions (e.g., straps) of a support garment, connect ends of belt, secure a footwear article, and the like. Operating some types of fasteners can present challenges. For example, some fasteners are difficult to operate or manipulate for users with limited dexterity and/or can be difficult to operate single-handedly. In addition, some fasteners can be uncomfortable to a wearer, such as when the fastener includes edges or protuberances that can rub, provide pressure against, or otherwise irritate the wearer's skin.

DETAILED DESCRIPTION OF DRAWINGS

The present assemblies and methods for an apparel fastener are described in detail below with reference to these figures.

Figure 12A:
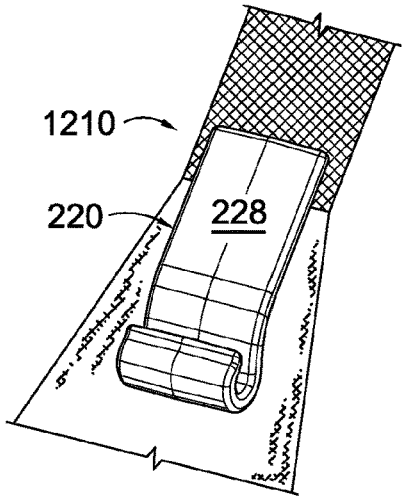

FIGS. 12A to 12 E depict various steps of another method of attaching a hook to an apparel article and a resulting construction, in accordance with examples of this disclosure.

FIGS. 13A to 13D depict various steps of another method of attaching a hook to an apparel article and a resulting construction, in accordance with examples of this disclosure.

DETAILED DESCRIPTION

This detailed description is related to a fastener that can be used with various apparel and that can be easier to operate and can be less likely to create discomfort to a wearer. In at least some examples, the fastener includes a hook, which can be connected to a first portion of the article (e.g., support garment such as a bra), and a receiver, which can be connected to a second portion of the article. The hook can be releasably connected to the receiver to selectively secure the first portion of the article to the second portion of the article. The receiver can include various elements, and in one example, the receiver includes a slot that can receive, at various angles and orientations, a bend of the hook. In addition, receiver can include a cross bar (e.g., anchor bar) that mates with the bend of the hook to retain the hook in a secure position with relatively limited side-to-side movement, while still allowing the hook to pivot relative to the receiver (e.g., to conform to the contour of a wearer's body). As such, the fastener can be operated with less precision (when engaging the hook to the receiver) while still providing a stable connection that easily hinges to conform with the wearer's body and movement.

In contrast to subject matter of the present disclosure, conventional fasteners can require, when operating the fastener, more precise alignment and manipulation between a first fastener component and a second fastener component. In addition, conventional fasteners can sometimes include a gate or other latch that closes the gape of a hook or other fastener component and must be opened or otherwise temporarily moved in order to connect the fastener. Conventional fasteners can also include a barrel or other type of threaded connection that must be rotatably screwed/unscrewed for operation. These and other instances of conventional fasteners can make single-handed operation and/or operation by users with limited dexterity very difficult. Furthermore, conventional fasteners can sometimes be bulky and/or include features that can dig into a wearer or otherwise cause discomfort.

Additional examples of the present disclosure are now described and are related to a fastener that can be used to connect two textile portions together, such as two textile portions of a garment (e.g., support garment, upper-body garment, lower-body garment, headwear, footwear, etc.) and/or equipment (e.g., backpack, duffle bag, etc.). In examples, the fastener includes a receiver and a hook, and the receiver is connected to a first textile portion, while the hook is connected to a second textile portion. The hook and receiver are releasably connectable to connect or disconnect the textile portions. In some instances, a length of one or more of the textile portions can be slidably adjusted relative to the fastener in order to adjust relatively positioning (e.g., to increase or decrease a size associated with a garment or a strap length associated with a bag).

The receiver can include various features for mating with the hook. For example, the receiver can include a slot for receiving a portion (e.g., bend) of the hook. In addition, the receiver can include a first cross bar (e.g., anchor bar) that forms a side of the slot and that is configured to releasably connect with the bend. In at least some examples, the slot is configured such that the hook can pass through the slot at different angle angles and orientations, which can ease operating the fastener by allowing for less precise alignment when connecting and/or disconnecting the hook and receiver. For example, the slot can include a first width that is farther away from the anchor bar and a second width that is closer to the anchor bar, the second width being shorter than the first width. As such, the slot can taper from a wider portion farther from the anchor bar to a narrower portion closer to the anchor bar, and the tapering sides can operate to funnel the bend to a securely seated connecting position on the anchor bar. As a result, the bend of the hook can be inserted into slot at various angles and orientations, and when moved to engage the anchor bar, the bend of the hook is directed to a secure location on the anchor bar by the tapering sides of the slot operating as guide rails.

The receiver can include other elements as well. For example, the receiver can include a second cross bar for engaging a strap (e.g., connected to, or forming part of, the first textile portion), which can be slidably adjusted relative to the receiver and the second cross bar in order to adjust a length of the strap. In addition, the receiver can include standoff portions that protrude from one side of the receiver. For example, the standoff portions can space the receiver apart from an underlying surface (e.g., a portion of a garment or a bag), such that the receiver is easier to grab for operation (as compared to if the receiver were lying flat against the underlying surface). In some examples, the standoff portions can form a channel that receives a portion of the strap, and in this sense, the standoff portions can operate as guide rails on either side of the strap for maintaining relative positioning between the strap and receiver (e.g., maintain the strap beneath the receiver and/or maintain the receiver adjacent the strap).

The hook can include various elements for mating with the receiver. For example, the hook can include a bend (e.g., for engaging the anchor bar of the receiver) and a shank, which can be used to affix the hook to the second textile portion and to handle or manipulate the hook. The shank can include various configurations (e.g., shapes, sizes, etc.), and in some examples, the shank is relatively flat and is relatively broad, such that the body of the shank is relatively wide, as compared to its thickness. In examples, the bend can include various elements for engaging the anchor bar. For example, the bend can include a rolled edge that is open at the terminal end to partially enclose a throat of the hook and form a gape, which provides a passageway to the throat. In examples, the throat and the gape are dimensioned to engage the anchor bar in a manner that allows for easier fastener operation and smooth fastener adjustment or movement to conform to wearer body shape and/or motion. For example, a gape width can be smaller than the anchor bar and a throat width can be larger than the anchor bar. As such, when the bend is moved onto the anchor bar, the anchor bar can frictionally engage the terminal end of the bend, and the bend can elastically deflect to an open position, which allows the anchor bar to pass into the throat. In examples, the width of the throat is configured to allow the hook to rotate relative to the anchor bar. In this sense, the bend and the anchor bar can include, when connecting or disconnecting, an interference fit (e.g., which flexes the bend open), and when the in a connected state, a clearance fit or a transition fit (e.g., which allows the parts to rotate relative to one another).

In examples, the hook and receiver is easy to use and enables a wearer to releasably mate the two components using, for example, one hand. As such, the fastener can be usable by people with disabilities and/or people whose other hand may be engaged in other activities such as, for example, supporting a baby or a breast-milk pump. In some instances, once the hook and receiver are connected, the relative lengths of the textile portions (e.g., the amount of support provided by the first and/or second textile portions) can be modified by pulling on a free first end of the strap connected to the receiver. This operation can also be carried out using, for example, one hand. The ability to provide an increased level of support when the garment is in the form of, for example, a nursing bra enables the bra to also be used for athletic activities, which can eliminate the need for a wearer to change from a nursing bra to an athletic bra when exercising. When the increased level of support is no longer needed, the strap can be manipulated to modify the length to provide desired support. In at least some examples, adjusting the relative lengths of the textile portions can modify a cup size of a support garment. For instance, in some examples it can be useful to provide a larger cup size when a wearer is pregnant, has recently given birth, and/or is nursing an infant, and after the infant is born and the wearer is no longer nursing an infant or pumping breast milk, it can sometimes be useful to provide a smaller cup size. According to examples of the present disclosure, the cup size can be modified by changing the relative lengths of the textile portions.

Some examples described herein are in the context of bras, including a nursing bra or a bra configured for breast-milk pumping. In other examples, subject matter of this disclosure can include a fastener used with other types of garments or equipment. For example, the fastener can be used at the waistband of a lower-body garment to quickly couple textile elements together and to quickly adjust the circumferential diameter of the waistband. When incorporated into an article of footwear such as an upper of a shoe, the fastener can be used to adjust the level of support across, for example, an instep region of the upper. The fastener can also be used as part of an underband of a bra to join two portions of the underband together and adjust the circumferential tension of the underband. These are just a few examples, and it is contemplated herein that the fastener can be incorporated into any type of garment for which a quick and easy coupling and adjustment of support is desired. In addition, the fastener can be incorporated into various other articles, such as bags (e.g., backpacks, duffle bags, etc.).

As used herein, the term "garment" means any article that may be worn by a wearer and can also be referred to as a "wearable article." Example wearable articles include support garments including bras and nursing bras, upper-body garments such as tops, pullovers, hoodies, jacket/coats, and the like, lower-body garments such as shorts, capris, leggings, pants, and the like, articles of headwear such as hats, caps, sweatbands, and the like, and articles of footwear including athletic shoes. The fastener can also be used in equipment such as backpacks, luggage, duffle bags, and the like.

Some positional terms might be used when describing the subject matter of this disclosure with the assumption that a subject item is being worn as intended by a wearer standing upright. For example, the term "inner" or "inward" can mean a layer or structure that is positioned closer to a body surface of a wearer as compared to other layers or structures of the garment. The term "outer" means a layer or structure that is positioned external to other layers or structures of the garment. In example aspects, an inner layer may be an innermost layer and an outer layer may be an outermost layer of the garment. An upper part of the garment would be located closer to a head area of a wearer compared to a lower part of the garment.

The term "support garment" when used herein refers to an upper-body garment primarily configured to provide support to a wearer's breasts. As such, the support garment can be in the form of a bra, including a nursing bra, pumping bra, and/or athletic bra, a tank top, an athletic top, a swimsuit top, and the like. When the garment is in the form of a support garment or bra, the term "breast-covering portion" means the portion of the support garment configured to cover a wearer's breast. As such, the breast-covering portion generally extends from a top part (e.g., near the wearer's clavicle) to a lower part (e.g., the wearer's inframammary fold) of each of the wearer's breasts and from a medial edge (e.g., near the wearer's sternum) to a lateral edge (e.g., near the wearer's axilla) of each of the wearer's breasts. The term "apex region" when referring to the support garment generally means the area where a shoulder strap extends from or is joined to the breast-covering portion or other portions of the support garment. The term "underband" when used in relation to, for instance, a bra refers to the portion of the bra that forms a lower margin of at least the front portion of the bra. The underband is configured to encircle the torso area of a wearer and may include a separate pattern piece or may include an integral extension of the front portion.

The term "strap" generally means an element having a greater length than width. In some examples, a strap includes at least some segment(s) along the length with parallel longitudinal side edges. In some examples, a strap can include some segments (e.g., end portions) with tapering longitudinal side edges (e.g., taper in width as the strap extends to a terminal end). The strap can be formed of textile elements (knit, woven, braided, nonwoven, and the like) or non-textile elements. In example aspects, the strap may be formed of a no-stretch or low-stretch material. A no-stretch or low-stretch material generally does not have inherent stretch properties (mechanical or elastic) in response to a tensioning force and thus the length and/or width of the material remains substantially unchanged when subject to the tensioning forces below the material's breaking/tearing point. For example, the strap may undergo a change of length from about 0% of resting length to about 20% of resting length in response to a tensioning force. The no-stretch or low-stretch material may include tightly knit, woven, or braided constructions that do not utilize elastic yarns; non-elastomeric films; knit, woven, nonwoven, or braided constructions that include a surface treatment to limit stretch, and the like.

As used herein, the term "about" means+/−10% of a subject term (e.g., quantity or other qualitative value). In addition, in some examples, size (e.g., lengths or widths) can be measured using a precision caliper.

The term "fixedly coupled" or "fixedly secured" generally means some type of permanent attachment through use of one or more of stitching, bonding, adhesives, welding, and the like. The term "slidably coupled" when referring to, for example, the receiver and a strap, means that the receiver can be moved (e.g., slid) along a length of the strap while maintaining the integrity of both the receiver and the strap. The term "releasably mated" or "releasably connected" (e.g., when referring to the relationship between the hook and receiver) means that the components can be repeatedly mated (i.e., joined together) and unmated without damaging either of the components.

Figure 1B:
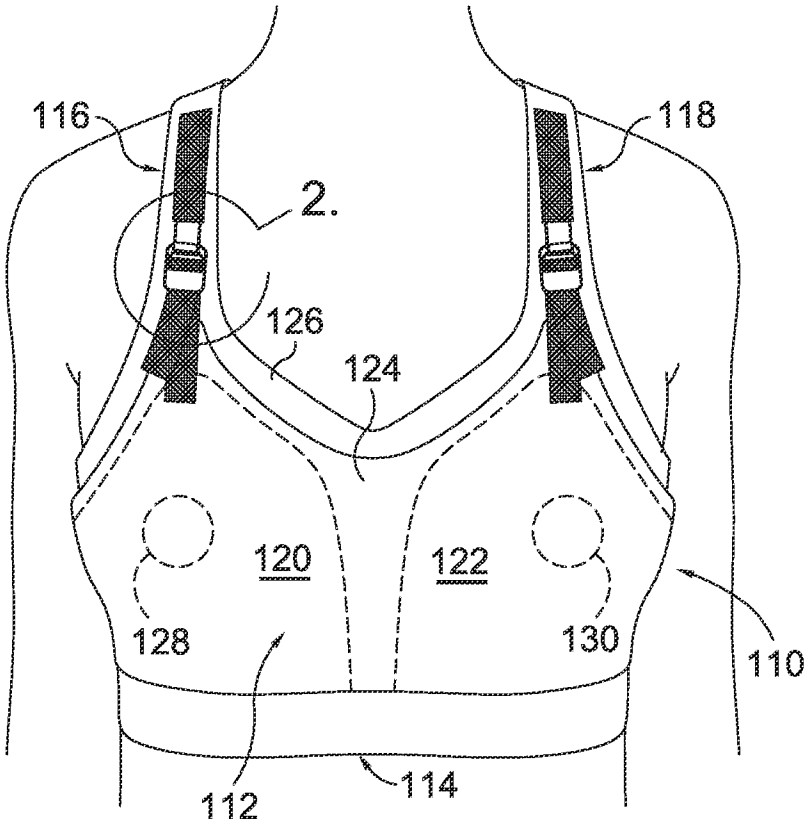
FIG. 1B depicts a support garment with a connected fastener, in accordance with examples of this disclosure.
Figure 1A:
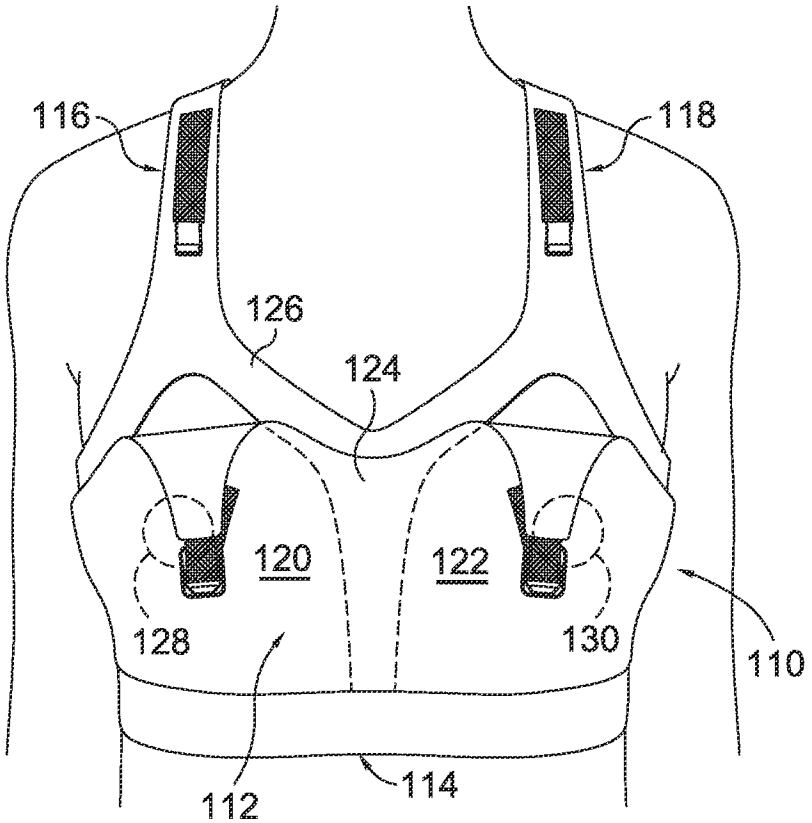
FIG. 1A depicts a support garment with a disconnected fastener, in accordance with examples of this disclosure.

Referring now to FIGS. 1A and 1B, according to an example, a support garment 110 is depicted, which includes a front portion 112, as well as an underband 114, a first shoulder strap 116, and a second shoulder strap 118. In examples, the first should strap 116 and the second shoulder strap 118 can support the support garment 110 on the wearer's shoulders, and the underband 114 can at least partially circumscribe a torso of the wearer. In examples, the support garment 110 can include a first textile portion and a second textile portion that are releasably connected. For example, the support garment 110 can include a first breast covering portion 120 that is releasably connected to the first shoulder strap 116 and can include a second breast covering portion 122 that is releasably connected to the second shoulder strap 118. That is, FIG. 1A depicts the first breast covering portion 120 disconnected or released from the first shoulder strap 116 and depicts the second breast covering portion 122 disconnected from the second shoulder strap 118, whereas FIG. 1B depicts the breast covering portions 120 and 122 connected to the respective shoulder strap 116 and 118. In examples, the first breast covering portion 120 and the second breast covering portion 122 can, when disconnected from a respective shoulder strap, allow for positioning of a breast-milk pump (or other object, such as a pad, protective element, prosthetic, etc.) and/or a nursing infant. In addition, when connected, the breast covering portions 120 and 122 can help retain a breast-milk pump or other object in position and/or provide a desired amount of support. In examples of the present disclosure, the support garment 110 depicts a bra, and in other examples the support garment 110 may include a variety of other types of support garments that include the same or similar elements.

In examples of the present disclosure, at least a portion of the support garment 110 (e.g., the front portion 112) can include a multilayer structure. For instance the front portion 112 can include a first layer 124 (e.g., first breast-covering layer including the first breast covering portion 120 and the second breast covering portion 122) and a second layer 126 (e.g., second breast-covering layer). The first layer 124 can also be described as an outer layer or an exterior layer, and the second layer 126 can be described as an inner layer or interior layer (e.g., relative to the first layer 124). For example, when the support garment 110 is worn, at least a portion of the second layer 126 can be positioned closer to the wearer than the first layer 124 and/or may be positioned between the first layer 124 and the wearer.

In examples, the multilayer structure may contribute to various operations and features of the support garment 110. For example, in at least some instances, an object can be retained between the first layer 124 and the second layer 126, such as a breast pump, breast prosthetic, pad, protective article, and the like. In this sense, one or more compartments (e.g., interlayer compartments) can be located between the first and second layers 124 and 126. In addition, a multilayer structure may provide an ability to incorporate into the support garment 110 different materials having different properties. For example, the first layer 124 and the second layer 126 may be constructed of different materials, the combination of which may provide different properties of the support garment 110 (e.g., breathability, permeability, support, comfort, softness, etc.). Examples of materials may include, but are not limited to, knit textiles, woven textiles, non-woven textiles, meshes, spacer meshes, foam sheets/padding, and the like.

Furthermore, the second layer 126 can include features configured for operability in various contexts. For instance, the second layer 126 can include openings 128 and 130, which can correspond with a shape associated with a breast pump (e.g., a hands-free breast pump), such as a shape that corresponds with at least a part of a flange or shield of the breast pump. For instance, at least a portion of the flange may be inserted through either of the openings 128 and 130 and positioned between the inner surface of the second layer 126 and the wearer's skin surface. In addition, if the support garment is used for nursing an infant, the opening can be configured to accommodate an infant's mouth and portions of the infant's face. In other examples, the second layer 126 can include a relatively open structure (e.g., less of a material panel) with one or more trim pieces, straps, or other material strips, that connect the shoulder straps 116 and 118 to the underband 114 and help retain the shoulder straps 116 and/or 118 on the wearer when a breast covering portion of the first layer 124 is disconnected.

The support garment 110 can include other features as well. For example, the support garment may include a material extension (e.g., a gusset or other panel structure) secured near a central region (e.g., bridge or other portion near a midline and between breast-covering portions) of the support garment 110 that may form a divider between the interlayer compartments. In some examples, the material extension may help retain the object in position and reduce the likelihood that the object might shift positions while contained in the interlayer compartment.

FIG. 1B depicts the first breast covering portion 120 connected to the first shoulder strap 116 and depicts the second breast covering portion 122 connected to the second shoulder strap 118. The first and second breast covering portions 120 and 122 can be connected to the shoulder straps 116 and 118 in various contexts, such as when the support garment 110 is retaining an object (e.g., breast-milk pump) and/or when the wearer is engaging in physical activity and/or normal activity. As such, it can be desirable to adjust an amount of support provided by the first breast covering portion 120 and the second breast covering portion 122, such as to help seat, and/or reduce shifting of, the breast-milk pump; to retain an object (e.g., pad, prosthetic, protective element, etc.) in position; and/or to tailor the support to a given activity level (e.g., more support might be useful for higher levels of activity and less support might be beneficial for lower activity levels).

Various assemblies can operate to releasably connect a breast covering portion to a shoulder strap. In accordance with examples of the present disclosure, a fastener is provided that can be used with various apparel and that can be easier to operate and can be less likely to create discomfort to a wearer. In at least some examples, the fastener is configured for one-handed operation (e.g., to connect, disconnect, and/or adjust an amount of support), such as when a wearer is also holding an infant and/or positioning a breast-milk pump. In addition, a fastener of the present disclosure can, in some instances, provide for easier (e.g., one-handed) adjustment of a textile or strap coupled to the fastener (e.g., to adjust an amount of support provided by the support garment 110). FIG. 1B includes, in accordance with an example, a reference callout to FIG. 2, which depicts an enlarged view of an example assembly that can connect the breast covering portion 120 to the shoulder strap 118.

Figure 2A:
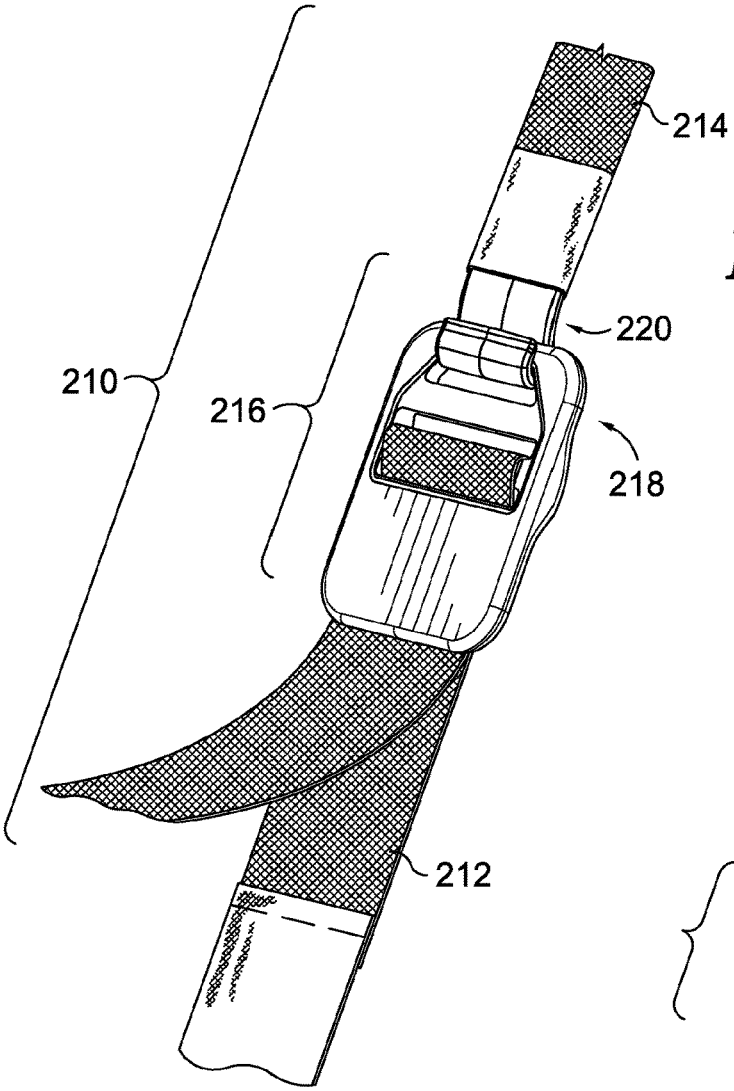
FIG. 2A depicts a fastener in a connected state, in accordance with examples of this disclosure.
Figure 2B:
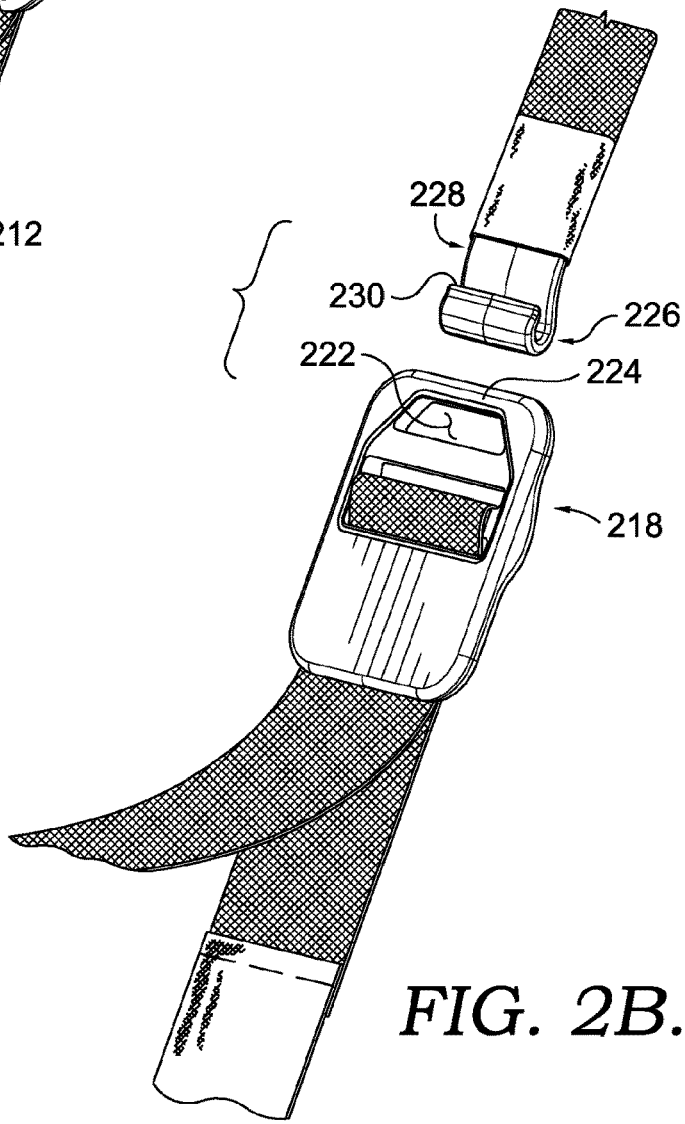
FIG. 2B depicts a fastener in a disconnected state, in accordance with examples of this disclosure.
Figure 3A:
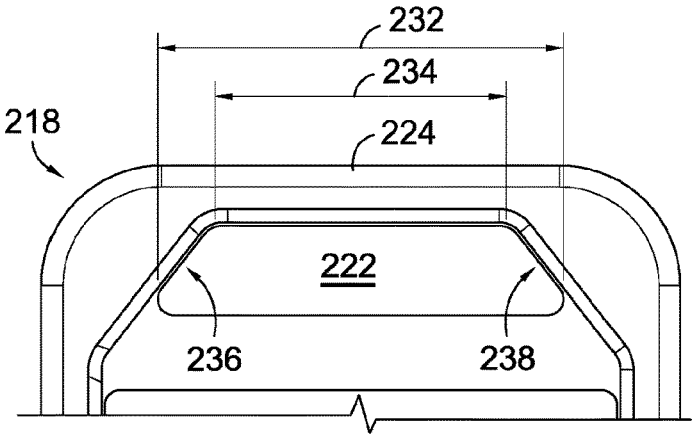
FIGS. 3A to 3F depict different orientations of a fastener, in accordance with examples of this disclosure.
Figure 3B:
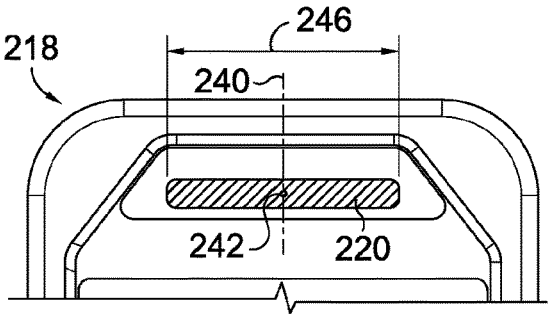
Figure 3C:
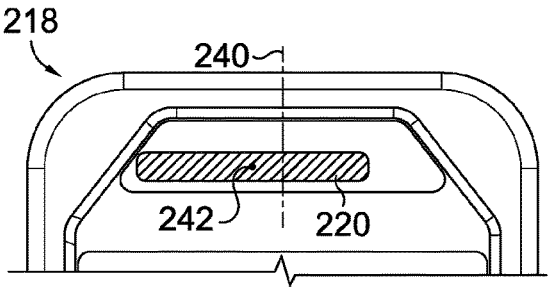
Figure 3D:
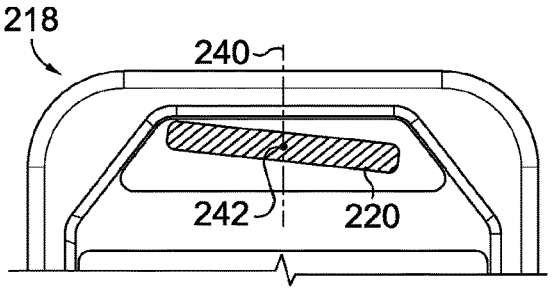
Figure 3E:
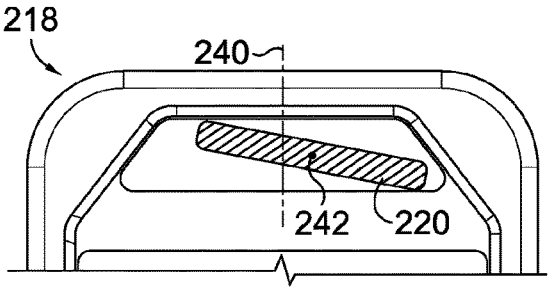
Figure 3F:
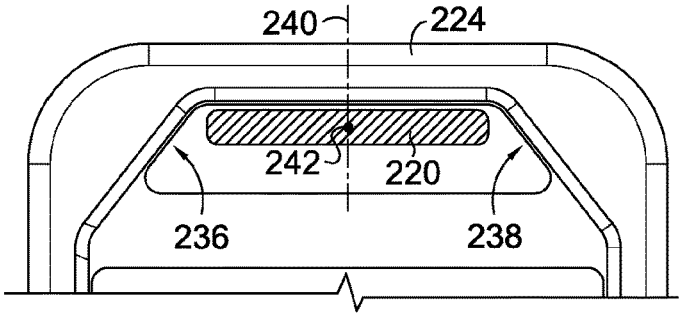
Figure 4C:
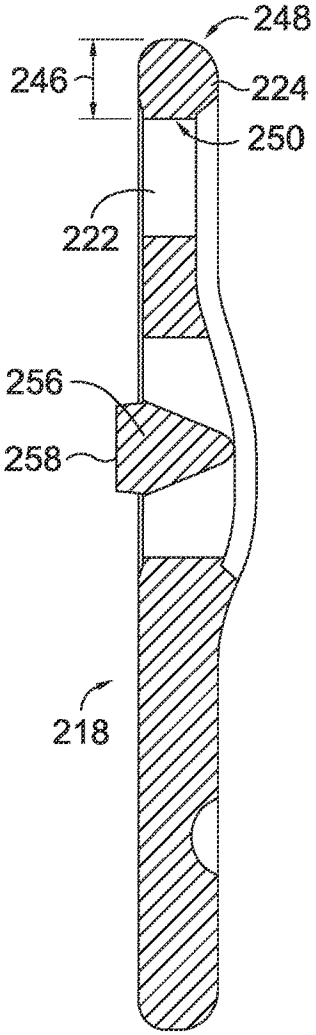
FIGS. 4A to 4D depict various views of a receiver portion of a fastener, in accordance with examples of this disclosure.
Figure 4B:
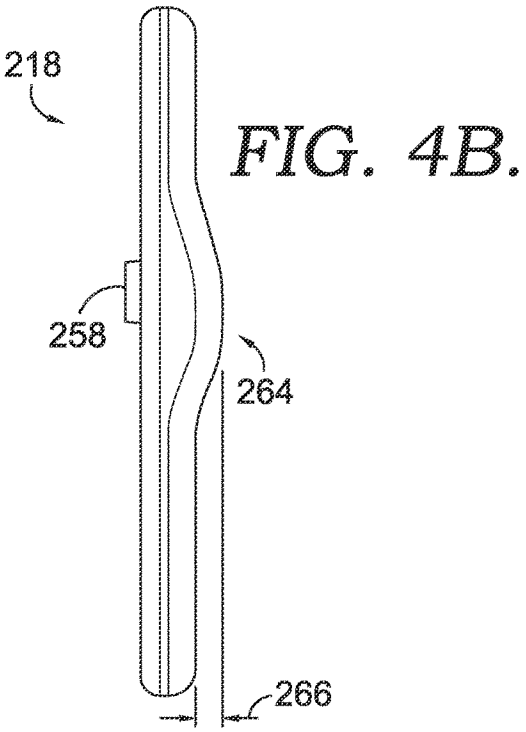
Figure 4D:
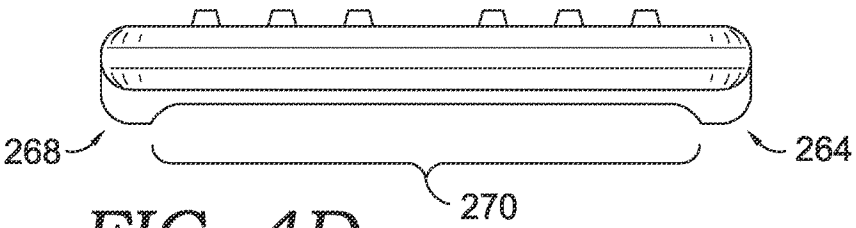
Figure 4A:
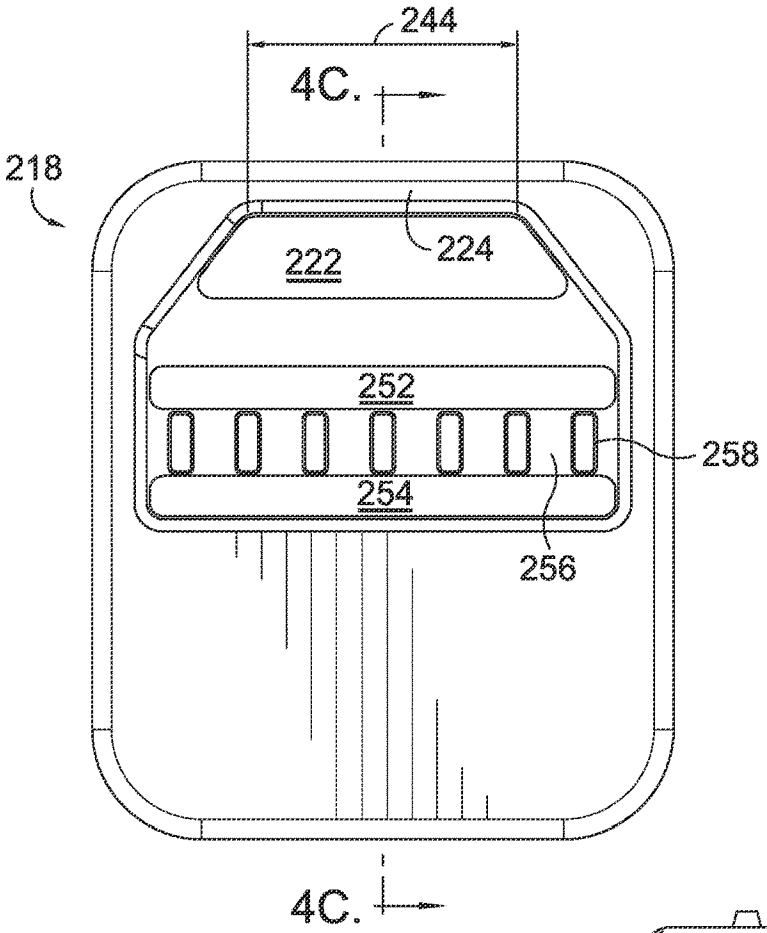

Referring to FIG. 2, FIG. 2 depicts a fastening assembly 210, which includes a first textile portion 212, a second textile portion 214, and a fastener 216 releasably connecting the first textile portion 212 to the second textile portion 214. In examples, the first textile portion 212 can include a strap connected to a breast covering portion, and the second textile portion 214 can be connected to a shoulder strap. In some examples, the first textile portion 212 and the second textile portion 214 can be connected to other types of garments or bags. In addition, the fastener 216 can include a receiver 218 connected to the first textile portion 212 and a hook 220 connected to the second textile portion 214. The hook 220 can be releasably mated to the receiver 218 to releasably connect the first textile portion 212 to the second textile portion. For example, FIG. 2A depicts, in state "A," the hook 220 connected to the receiver. FIG. 2B depicts, in state "B," the hook 220 and the receiver 218 disconnected. The arrow "C" indicates the hook 220 and the receiver 218 are configured to be repeatedly connected and disconnected without damaging their structural integrity.

In examples, the receiver 218 and/or the hook 220 can include various features. For example, the receiver 218 can include a slot 222 for receiving a portion of the hook 220. In addition, the receiver can include a first cross bar 224 (e.g., anchor bar) that forms a side of the slot 222 and that is configured to releasably connect with the hook 220. Further, in at least some examples, the hook 220 includes a bend 226 and shank 228. The bend 226 can include, among other things, a terminal edge 230 that is folded back over the hook 220 an is spaced apart from an opposing part of the hook 220 to form a gape, which provides a passageway for the anchor bar 224 to mate in the throat of the hook.

In at least some examples, the slot 222 is configured such that the hook 220 can pass through the slot at different angles and orientations, while still achieving an aligned connection for the fastener, which can ease operating the fastener by allowing for less precise alignment when connecting and/or disconnecting the hook and receiver. These features can ease operation when, for example, the user is attempting to connect/disconnect with one hand (e.g., when the other hand is holding an infant or supporting a breast-milk pump) and/or the user has limited dexterity. For example, referring to FIG. 3, the slot 222 can include a first width 232 that is farther away from the anchor bar 224 and a second width 234 that is closer to the anchor bar 224, the second width 234 being shorter than the first width 232. In some examples, the second width 234 can be similar to a length of the anchor bar 224 (e.g., a length extending from one side of the receiver 218 to the opposite side of the receiver 218). In addition, the slot 222 can include a first side frame 236 that forms a first side or perimeter around a first side of the slot 222 and a second side frame 238 that is generally opposite the first side frame 236 and that forms a second side or perimeter around a second side of the slot 222. In examples, the first side frame 236 and the second side frame 238 can taper towards one another as each extends towards the anchor bar 224. As such, the slot 222 can taper from a wider portion farther from the anchor bar 224 to a narrower portion closer to the anchor bar 224.

As depicted in FIG. 3, when connecting the fastener 216, the hook 220 can include different orientations relative to the receiver 218. For example, as depicted by FIG. 3B, a midline 240 of the anchor bar can be aligned with a midpoint 242 of the hook 220, and the hook 220 can include little or no rotation (e.g., relative to an axis extending perpendicular to the page). In addition, as depicted in FIG. 3B, the hook 220 can include a width 246 (e.g., in a transverse cross section), which can be less than the width 234 that is associated with the length of the anchor bar 224. In another example, as depicted by FIG. 3C, the midpoint 242 of the hook 220 can be laterally shifted relative to the midline 240 of the receiver 218. In another example, as depicted by FIG. 3D, the midpoint 242 of the hook 220 can be aligned with the midline 240 of the receiver, but the hook 220 may be rotated (e.g., on an axis extending into or perpendicular to the page) relative to the anchor bar 224. In a further example, as depicted by FIG. 3E, the midpoint 242 can be misaligned with the midline 240, and the hook 220 can be rotated. FIGS. 3B-3E are merely examples, and in other instances, the hook 220 can include other orientations relative to the anchor bar 224. In examples of the present disclosure, the tapering sides 236 and 238 can operate to funnel the hook 220 to a securely seated connecting position (e.g., FIG. 3F) on the anchor bar 224. As a result, the bend of the hook 220 can be inserted into slot at various angles and orientations, and when moved to engage the anchor bar 224, the bend of the hook 220 is directed to an aligned position on the anchor bar 224 by the tapering sides 236 and 238 of the slot 222 operating as guide rails. Although FIG. 3F depicts the midline 240 passing through the midpoint 242, in other examples, the connection between the hook 220 and the receiver 218 can still be deemed "aligned," if the distance between the midline 240 and the 242 is in a range between about 1% and 5% of the width 234.

Referring now to FIGS. 4A, 4B, 4C and 4D, enlarged views of the receiver 218 are shown, in accordance with examples of this disclosure. As previously described the receiver 218 includes the slot 222 and the anchor bar 224. In examples, the anchor bar 224 includes a length 244, which can be similar to the width 234, and can be based on the end points of the anchor bar 224 relative to the slot 222 (e.g., where the anchor bar 224 transitions to the side frames 236 and 238. The length 244 can vary, and in one example, the length is between about 7 mm and about 13 mm, or about 8.5 mm and about 11.5 mm, or about 10.2 mm. In addition, the anchor bar 224 can include a width 246 that extends between a terminal end side 248 of the anchor bar 224 and a slot side 250 that faces towards the slot 222. The width 246 can vary, and in one example, the width is between about 1.5 mm and about 2.5 mm, or about 1.75 mm and about 2.25 mm, or about 1.9 mm. In one example, the length 244 is about 4.5× to 5.5× the size of the width 246. These are examples of sizes and dimensions in accordance with examples, and in other instances, the relative sizes can be smaller or larger than these examples ranges and dimensions. In addition, in some examples, the various parts of the hook and the receiver can be scaled according to a desired use or application.

Figure 5A:
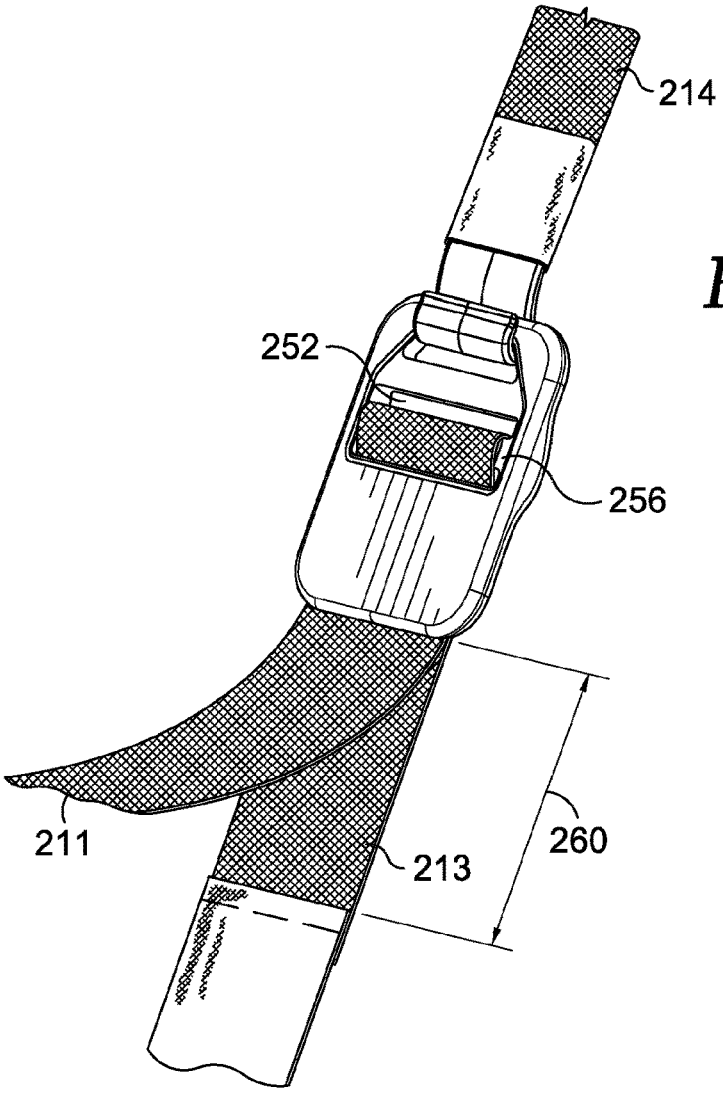
FIGS. 5A and 5B depict various views of an adjustment of a strap coupled to a fastener, in accordance with examples of this disclosure.
Figure 5B:
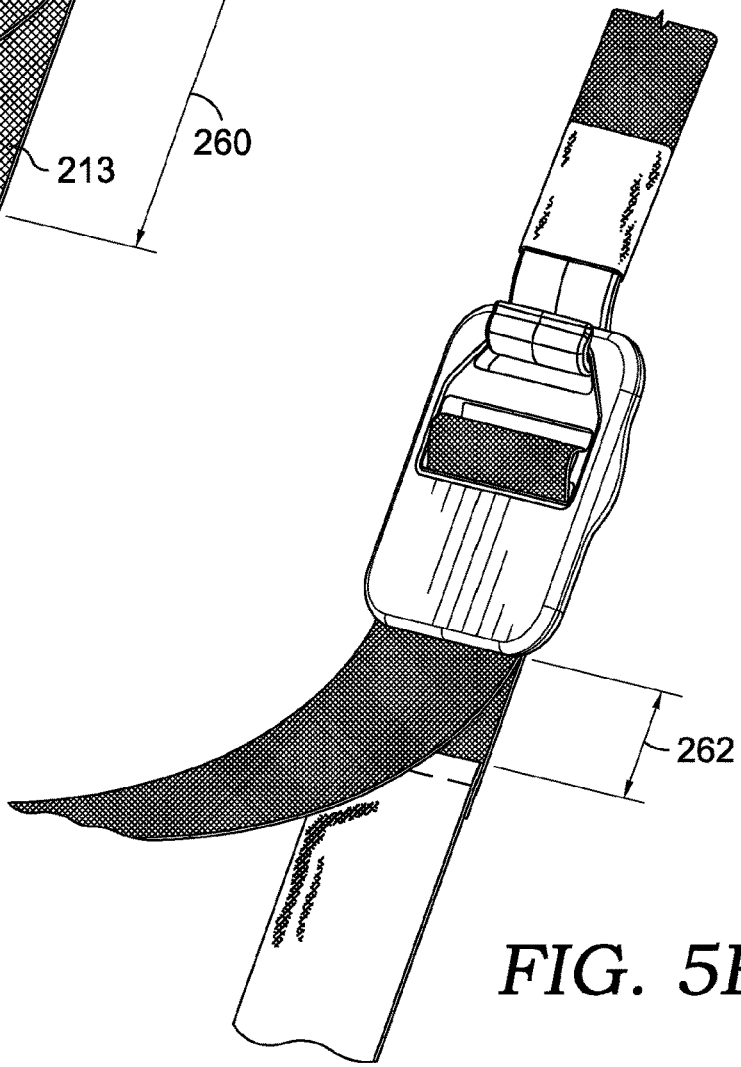

In some examples, the receiver 218 includes a second slot 252 and a third slot 254 that are configured to receive a portion of a strap (e.g., textile portion 212). In addition, the receiver 218 can include a second cross bar 256 with ridges 258. In examples, a strap (e.g., 212) can pass through the second and third slots 252 and 254 and around the second cross bar 256 to provide a slidably adjustable connection between the receiver 218 and the strap. For example, referring to FIGS. 5A and 5B, an end 211 of the strap 213 can be threaded through the slots 252 and 254 and around the second cross bar 256 (some of which are obscured from view by the strap). In examples, a length 260 of the strap 213 relative to the receiver 218 can be adjusted by pulling on the end 211 or by feeding the free portion of the strap back through the receiver 218. For example, FIG. 5B represents the relative positioning and the length 262, which is shorter than the length 260. When the strap 213 is connected to a breast covering portion, then adjusting the strap 213 in this manner (e.g., by pulling on the end 211 and reducing the length 262) can increase the amount of support provided by the breast covering portion. Vice versa, feeding the strap 213 back through the receiver 218 can reduce the amount of support. In addition to adjusting an amount of support, adjusting the strap in this manner can adjust a cup size of the breast covering portion. For instance, in some examples it can be useful to provide a larger cup size when a wearer is pregnant, has recently given birth, and/or is nursing an infant, and after the infant is born and the wearer is no longer nursing an infant or pumping breast milk, it can sometimes be useful to provide a smaller cup size. According to examples of the present disclosure, the cup size can be modified by changing the relative lengths of the textile portions. In at least some examples, the ridges 258 can frictionally engage the strap 213 to help retain the strap in a desired position.

In at least some examples, the receiver 218 can include additional elements. For example, the receiver 218 can include one or more protrusions or standoffs 264 (e.g., FIGS. 4B and 4D) that protrude from the receiver 218 and that are configured to space the receiver 218 apart from an underlying surface (e.g., the wearer or a garment of the wearer) by a distance 266. The distance 266 can vary, and in one example, the distance 266 is between about 0.75 mm and about 1.25 mm, or about 0.90 mm and about 1.1 mm. In some examples, the standoffs 264 can enable the receiver to be grasped more easily by providing the space between the receiver 218 and the underlying surface. In addition, the receiver 218 can include a first standoff 264 and a second standoff 268, which are spaced apart from one another on opposing sides of the receiver 218 and which form sides of a channel 270 positioned between the standoffs 264 and 268. In at least some examples, the channel 270 is configured to receive at least a portion of the strap 213. As such, nesting at least a portion of the strap 213 in the channel 270 can contribute to a lower profile of the assembly. In addition, the nesting relationship can help to maintain a position of the receiver relative to the strap (e.g., the receiver can remain adjacent the strap).

Figure 6A:
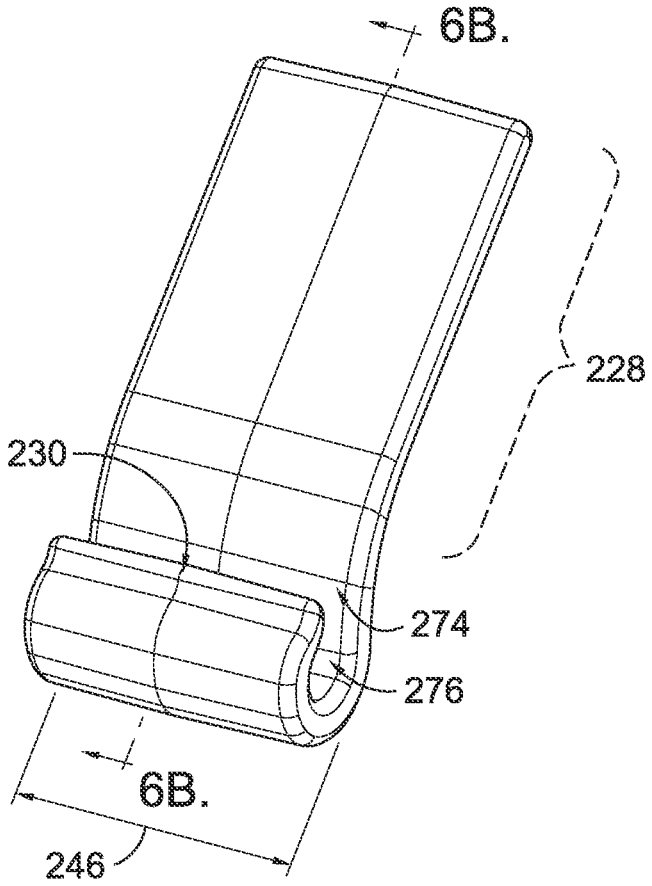
FIG. 6A depicts a perspective view of a hook portion of a fastener and 6B depicts a cross section of the hook portion, in accordance with examples of this disclosure.
Figure 6B:
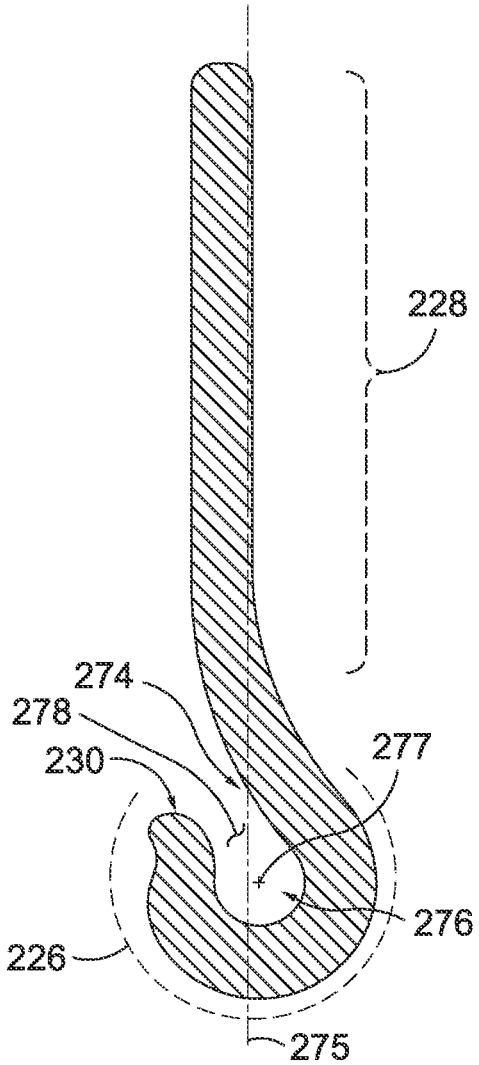
FIG. 6C depicts portions of a hook portion and a receiver portion of a fastener, in accordance with examples of this disclosure.
FIG. 6D depicts an elevation view of the hook portion engaged with the receiver portion, in accordance with examples of this disclosure.
Figure 6C:
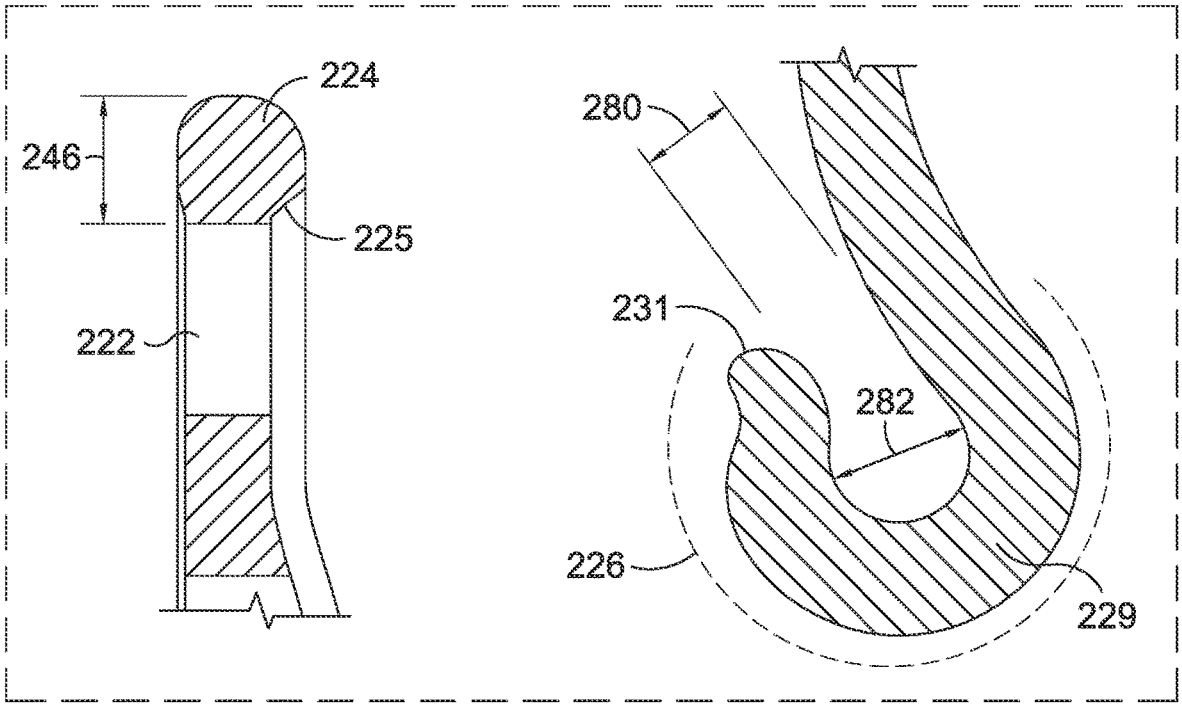

Referring now to FIGS. 6A, 6B, and 6C, at least some examples associated with the hook 220 are provided. The hook 220 includes the bend 226 and the shank 228. In examples, the shank 228 can be affixed to a textile portion. For example, the shank 228 can be affixed (e.g., bonded, stitched, etc.) within a tubular textile sleeve and/or to a strap. In addition, the shank 228 can be configured to provide a handle for grasping the hook and operating the hook 220 and/or the fastener 216.

In examples, the bend 226 includes a terminal edge 230 of the hook 220 that is curved and/or that curls back onto itself. In some instances, when in use or installed on a garment, the bend 226 and the terminal edge 230 can face or be oriented away from the wearer. In at least some examples, this can orient the opening of the gape outwards and allow the fastener to be operated by maneuvering the receiver onto the bend 226. In examples, the terminal edge 230 is spaced apart from the opposing side 274 of the hook 220, such that the bend 226 partially encloses a throat 276 of the hook 220 and a gape 278 extends between the terminal edge 230 and the opposing side 274. The gape 278 can provide a passageway to the throat 276. In addition, FIG. 6B includes a reference line 275, which is aligned with an inner facing surface of the broad, flat shank 228 (e.g., the inner facing side, such as when the hook 220 is affixed to a garment). FIG. 6B also includes an approximate midpoint 277 of the throat 276, the midpoint 277 being approximately midway between the front or outer side of the bend 226 and the back or inner side of the bend 226 (e.g., outer and inner being based on when the hook 220 is affixed to a garment). In at least some examples, the midpoint 277 is substantially aligned with the reference line 275 and/or is positioned further inward than the reference line 275 (e.g., to the right based on the cross section of FIG. 6B). In some examples, the midpoint 277 being at least even with or further inward than the reference line 275 can provide a relatively low profile fastener, since the receiver 218, when connected to the bend 226 is also retained closer to the garment (as compared to other fasteners in which the bend extends further away from the garment).

In examples, the throat 276 and the gape 278 are dimensioned to engage the anchor bar 224 in a manner that allows for easier fastener operation and smooth fastener adjustment or movement to conform to wearer body shape and/or motion. For example, referring to FIG. 6C a reference view is provided showing a portion of the receiver 218, including the anchor bar 224 and the width 246, and a portion of the bend 226. As depicted in FIG. 6C, the gape 278 can include a gape width 280, and the throat 276 can include a throat width 282. In at least some examples, the gape width 280 can be smaller than the anchor bar (e.g., smaller than the width 246). Further, in at least some examples, the throat width 282 can be larger than the anchor bar (e.g., larger than the width 246). As such, when the bend 226 and the anchor bar 224 are moved into engagement, the anchor bar 224 can frictionally engage the terminal edge 230 of the bend 226 (e.g., a temporary interference fit), and the bend 226 can temporarily elastically deflect to an open position, which allows the anchor bar 224 to pass into the throat 276.

In at least some examples, the bend 226 can include a bend segment 229 that is generally opposite the gape 278 and that elastically hinges to open the gape 278 for allowing passage of the anchor bar 224. In addition, in some instances, the elastic opening and closing action of the bend can create feedback to the operator that the fastener has been engaged. For example, engagement of the anchor bar 224 into the bend 226 can create an audible "click" and/or can provide a tactile feedback to the operator. In at least some examples, the throat width 282 is configured to allow the hook 220 to rotate relative to the anchor bar 224. For example, the throat width 282 can be similar to, or slightly larger than, the width 246, which can provide sufficient clearance to allow the hook 220 to rotate relative to the anchor bar 224. In at least some examples, the engagement between the anchor bar 224 and the bend 226 can include a clearance fit or a transition fit.

In at least some examples, the receiver 218 and/or the hook 220 can include features to assist with guiding the anchor bar 224 into the gape 278. For instance, in some examples the edge 230 can include a rounded distal end 231 that flares wider than the gape 278 as the surface of the edge 230 extends away from the gape, which can provide a wider insertion mouth to receive the anchor bar 224 and direct the anchor bar 224 into the gape 278. In addition, the anchor bar 224 can include one or more faces (e.g., 225) that are configured to help guide the anchor bar 224 into the gape (e.g., as opposed to fewer faces with sharper edges that can catch as the anchor bar 224 is inserted).

The receiver 218 and the hook 220 can be constructed of various materials. In at least one example, the receiver 218 and the hook 220 are constructed of a polymer (e.g., thermosetting polymer). In some examples, the receiver 218 and the hook 220 may be constructed of materials having different material properties. For example, in one example the receiver 218 can be constructed of a material imparting sufficient rigidity to allow the anchor bar 224 to be repeatedly connected and disconnected from the hook 220. In some instances, the hook 220 can be constructed of a material that imparts flexibility and/or elasticity to allow the bend to 226 to flex open and closed when the anchor bar 224 passes through the gape 278. In at least some examples, the receiver 218 and the hook 220 can be constructed of the same material and can be structurally configured to achieve a particular function. For example, a thickness of the anchor bar 224 can be configured to provide sufficient rigidity, and a thickness of the bend 226 at one or more positions can provide an ability to flex.

Figure 6D:
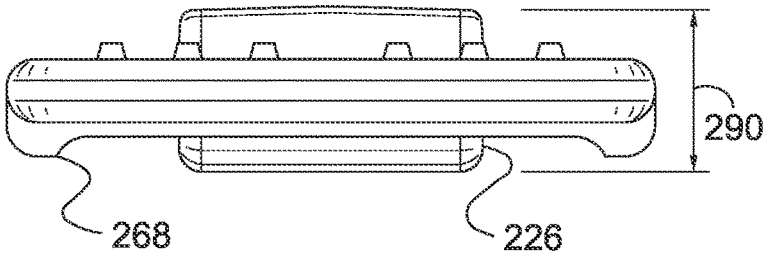

In at least some examples, the receiver 218 and the hook 220 can provide a relatively low profile fastener. For example, referring to FIG. 6D, the bend 226 of the hook is illustrated, and in some examples, the bend 226 includes an outer diameter 290 (or other maximum measurement from one external surface on one side of the bend to another external surface on the other side of the bend). In examples, the diameter 290 can be in a range of about 4.25 mm to about 6.25 mm, or about 4.75 mm to about 5.75 mm, or about 5 mm to about 5.50 mm, or about 5.3 mm.

Figure 7A:
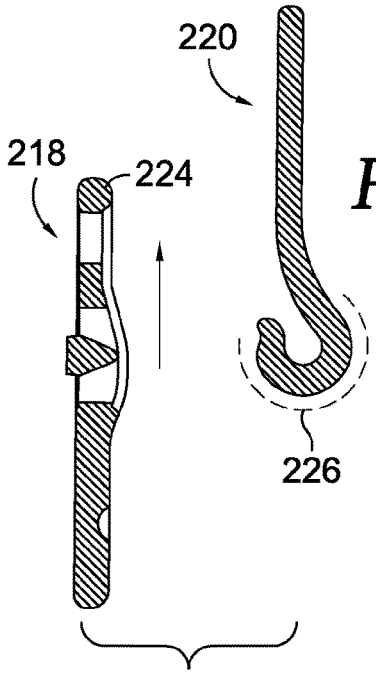
FIGS. 7A to 7D depict steps for operating a fastener, in accordance with examples of this disclosure.

In examples of the present disclosure, the fastener 216 of the present disclosure can be easily operated, such as by using a single hand or by an operator with limited dexterity. For example, referring to FIGS. 7A to 7D, a sequence of operations are outlined for easy operation of the receiver 218 and the hook 220. FIG. 7 includes, in association with each operation, a pictorial of the fastener 216 (e.g., in cross section) to help illustrate the step. In FIG. 7A, the receiver 218 is aligned relative to the bend 226 of the hook 220. For example, if the hook 220 is affixed to a shoulder strap of a garment, then the operator can grasp the receiver 218 and lift the receiver 218 to an appropriate height relative to the bend 226 that will allow the receiver 218 to be lifted onto the hook 220.

Figure 7B:
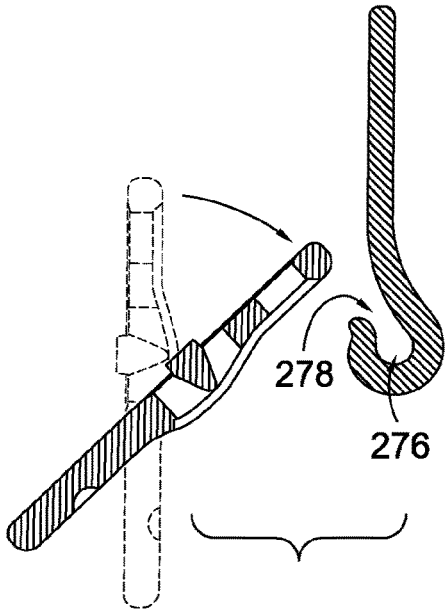
Figure 7C:
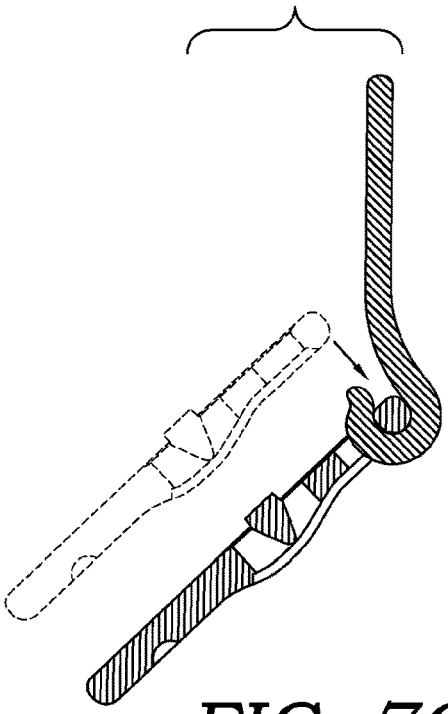
Figure 7D:
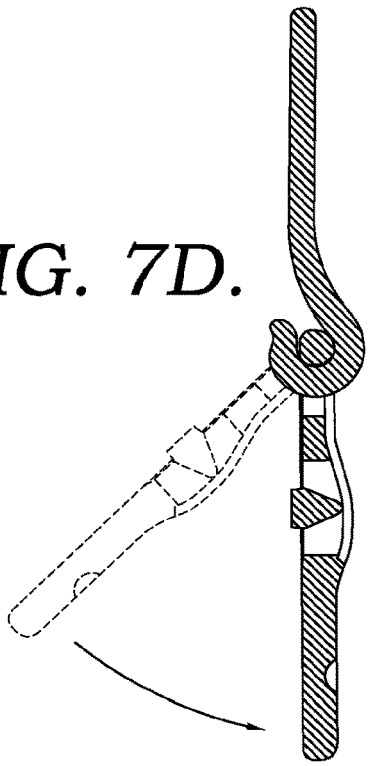

In at least one example, illustrated in FIG. 7B, the receiver 218 can be angled relative to the hook 220. For example, a lower portion of the receiver 218 can be pulled outward and away from the wearer, while an upper portion of the receiver 218 can be oriented towards the hook 220. Further, in FIG. 7C, the anchor bar 224 of the receiver 218 can be moved through the gape 278 and into the throat 276 of the hook 220. As described above, the gape width can be smaller than the width of the anchor bar (e.g., smaller than the width of the anchor bar), while the throat width can be larger than the width of the anchor bar. As such, when the bend 226 and the anchor bar 224 are moved into engagement, the anchor bar 224 can frictionally engage the terminal edge of the bend 226, and the bend 226 can temporarily elastically deflect to an open position, which allows the anchor bar 224 to pass into the throat 276. Then, once the anchor bar 224 is fit into the throat, as illustrated by FIG. 7D, the anchor bar can rotate or pivot relative to the hook to adjust to an underlying contour of the wearer or the garment. In addition, in at least some examples, the anchor bar 224 can be disengaged from the bend 226 by reversing the order described above.

In some examples, the fit between the hook and the receiver can include different types, depending on the stage in the connection process. For example, when the anchor bar 224 and the bend 226 are moved into engagement, such that the anchor bar 224 frictionally engages the terminal edge of the bend 226, the fit can be described as an "interference fit." In another example, when the anchor bar 224 is retained in the throat 276, and the receiver and the hook can rotate with respect to each other, the fit can be referred to as a "clearance fit" or a "transition fit," in which enough clearance (relative to the bend 226) exists around at least part of the anchor bar 224 to permit the bend 226 to rotate around the anchor bar 224.

Figure 8:
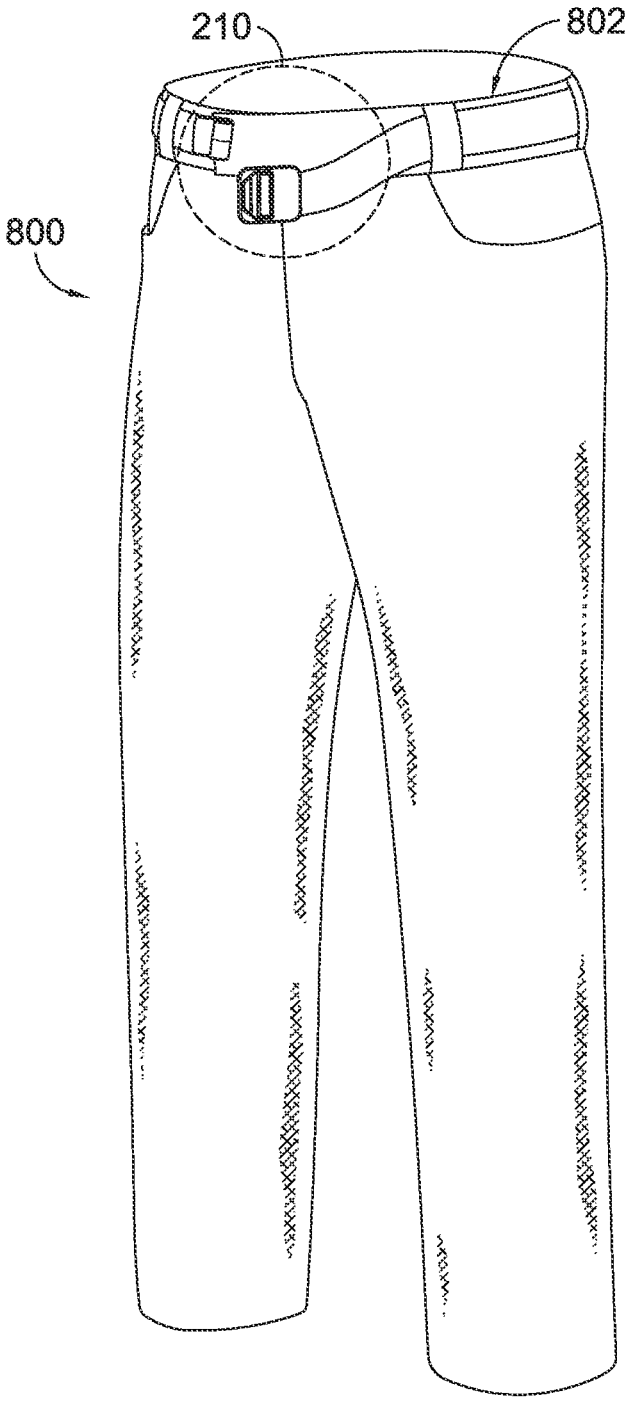
FIG. 8 depicts a lower-body garment with a fastener, in accordance with examples of this disclosure.

Referring to FIG. 8, in at least some examples, the fastening assembly 210 can be incorporated into a pant garment, such as into a waistband of a lower-body garment 800. The lower-body garment 800 is shown in the form of a pant, but other configurations such as shorts, leggings, capris, and the like are contemplated herein. The lower-body garment 800 includes a waistband area 802 configured to encircle a waist area of the wearer. In example aspects, the fastening system 210 can be associated with the waistband area 802. FIG. 8 depicts the assembly 210 in an un-coupled state, which can be useful when a wearer is donning the lower-body garment 800. In examples, the fastener 216 of the fastening assembly 210 can be connected, such as by executing the operations outlined in FIG. 7, which can effectively couple the first side of the waistband area 802 with the opposite second side of the waistband area 802. To tighten the waistband area 802, a wearer can pull and end of one of the straps, as described with respect to FIG. 5.

Figure 9:
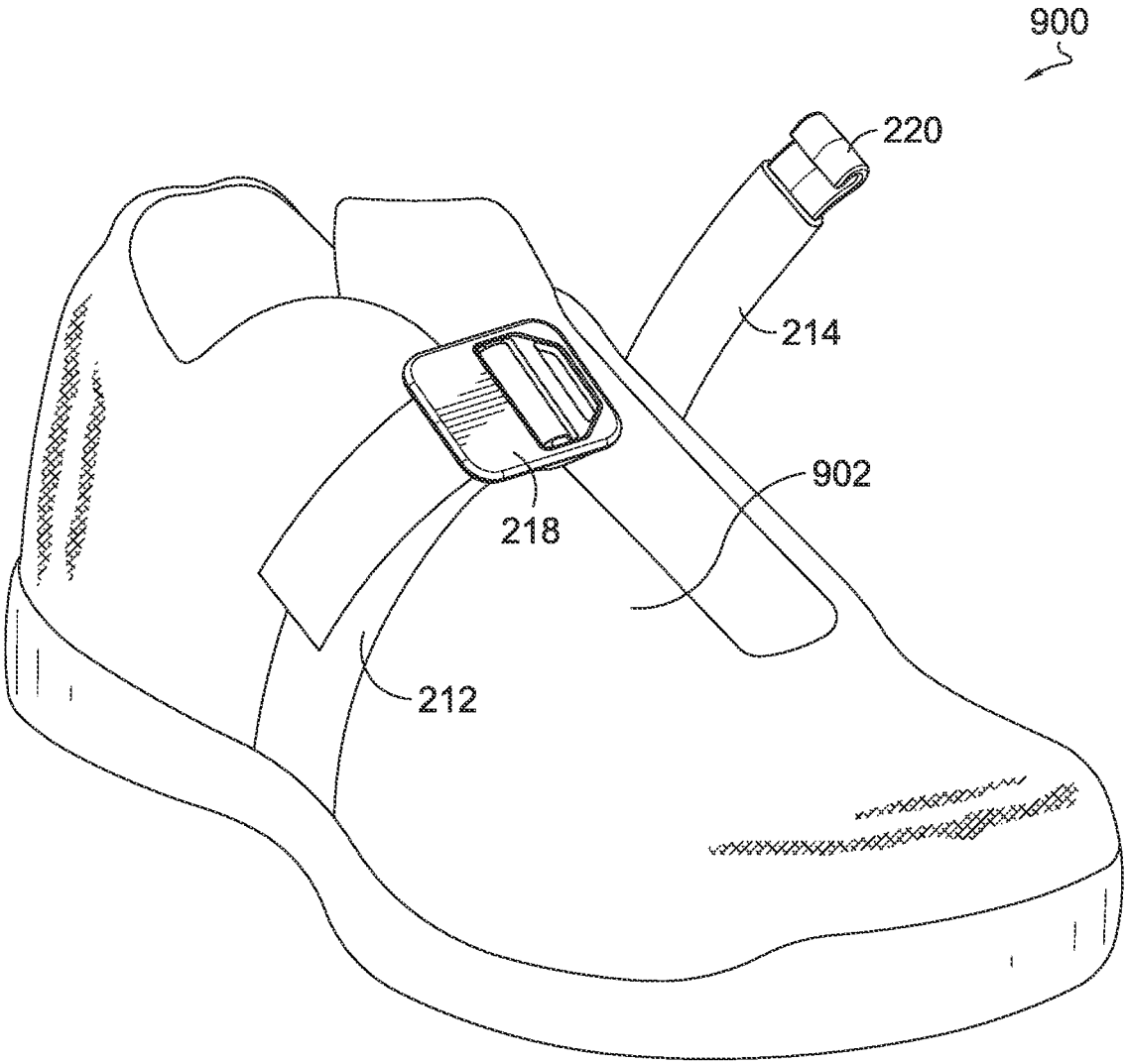
FIG. 9 depicts a footwear article with a fastener, in accordance with examples of this disclosure.

FIG. 9 depicts yet another example use of the assembly 210 incorporated into an article of footwear 900 in the form of an upper 902 for a shoe. The upper 902 may be formed from a variety of materials including leather, synthetic leather, knit materials, woven materials, braided materials, polymer sheets, rubber, and the like. In example aspects, the article of footwear 900 includes the assembly 210, including the first textile portion 212 (e.g., strap), the second textile portion 214, the receiver 218, and the hook 220. In examples, the assembly 210 can extend across an instep area of the upper 902 (e.g., when in a coupled state) and can be used to secure the upper across the instep and/or adjust a fit of the upper 902, such as by tightening the strap 212.

As indicated above, in examples of the present disclosure, the hook 220 can be coupled to a textile element, such as a strap. For example, the broad, flat shank 228 can provide an attachment point for the hook 220 to be coupled to the strap. The present disclosure includes examples (e.g., FIGS. 10-13) of a construction of the hook 220 with a strap or other textile element, as well as operations or steps that can be carried out to assembly the construction.

Figure 10A:
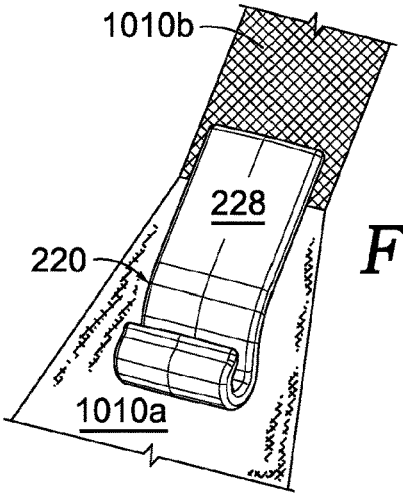
FIGS. 10A to 10F depict the various steps of a method of attaching a hook to an apparel article and a resulting construction, in accordance with examples of this disclosure.

Referring to FIG. 10A, the hook 220 can be positioned adjacent to a first textile layer 1010 of an article (e.g., a wearable article, bag, etc.). In some examples, the first textile layer 1010 can include a base layer of a strap for a support garment (e.g., at least a portion of strap 116/118 of the support garment 110), and the base layer can include a textile layer positioned between the hook 220 and the wearer. That is, the textile layer 1010 can be positioned internal or inner relative to the hook 220.

The first textile layer 1010 can include one or more of a variety of different types of textiles, including knit, woven, nonwoven, mesh, spacer textile, spacer mesh, foam padding, films, membranes, and the like. In some examples, the first textile layer 1010 can include a single textile layer. In some instances, the first textile layer 1010 can include multiple textile layers that are stacked (e.g., a padding layer with a knit layer forming an innermost surface). In some instances, the first textile layer 1010 can include a laminate of multiple textile layers.

In some instances, the first textile layer 1010 can include two or more textiles panels or pattern pieces 1010*a* and 1010*b* that are affixed at a seam (e.g., attached by stitching, seam tape, etc.). For example, the textile panel 1010*a* can be continuous with, or connect to, the an inner layer of a support garment (e.g., 126 of the support garment 110). In such examples, the textile panel 1010*a* can include a mesh. In some instances, the textile panel 1010*b* can include a portion of the support garment strap that is configured to extends from the front portion of the bra, over the shoulder of the wearer, and to the back portion of the bra. In such examples, the textile panel 1010*b* can include one or more layers of padding (e.g., foam padding, spacer textile, etc.). In some cases, the one or more layers of padding can include a liner layer that provides an innermost surface of the strap.

Figure 10B:
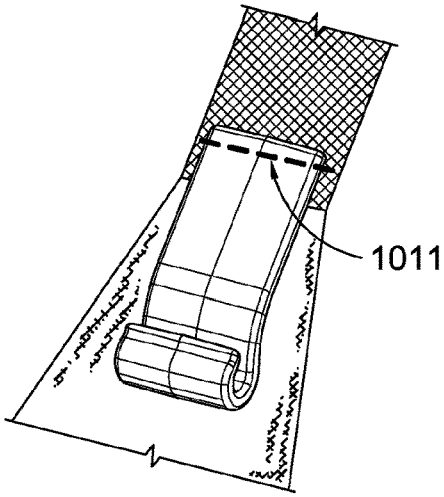

In some examples, as depicted by FIG. 10B, the hook 220 is positioned such that the shank 228 overlaps a seam between the textile panels 1010*a* and 1010*b*. In at least some instances, the hook 220 is coupled to the first layer 1010. For example, a fastener 1011, such stitches, can be affixed through the shank 228 and the first layer 1010, and other fasteners are also contemplated, such as rivets, adhesive bonding, etc. In some examples, the fastener extends through the textile panel 1010*b*. The fastener may not extend through the textile panel 1010*a*.

Figure 10C:
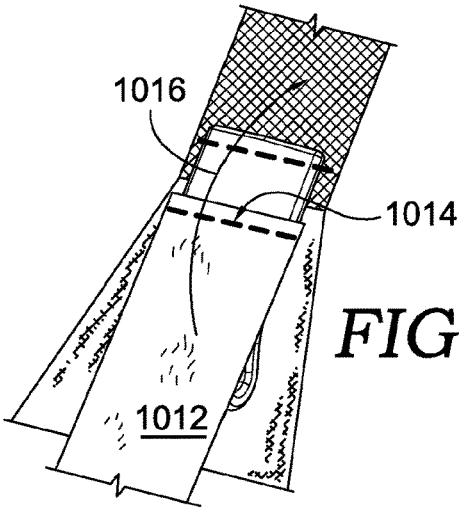

In at least some examples, as depicted by FIG. 10C, a second textile layer 1012 can be positioned on the side of the hook 220 that is opposite the first textile layer 1010. The second textile layer 1012 can include one or more of a variety of different types of textiles, including knit, woven, nonwoven, mesh, spacer textile, spacer mesh, foam padding, films, membranes, and the like. In some examples, the second textile layer 1012 can include a single textile layer. In some instances, the second textile layer 1012 can include multiple textile layers that are stacked (e.g., a padding layer with a knit layer forming an innermost surface). In some instances, the second textile layer 1012 can include a laminate of multiple textile layers.

The second textile layer 1012 can be coupled to the hook 220. For example, a fastener 1014, such as stitches, can be affixed through the shank 228 and the second textile layer 1010, and other fasteners are also contemplated, such as rivets, adhesive bonding, etc. In some examples, the fastener may not extend through the first textile layer 1010. In other examples, the fastener can extend through the first textile layer 1010.

Figure 10D:
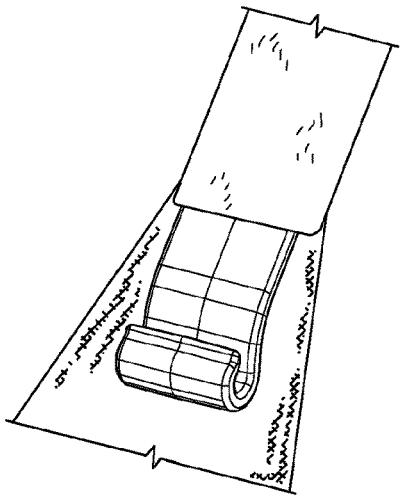

As depicted by FIG. 10D, the second textile layer 1012 can be moved (e.g., folded) to cover the fastener 1014, such as indicated by the arrow 1116. In such cases the second textile layer 1012 can overlap with at least a portion of the textile panel 1010*b*.

The second textile layer 1012 can include a variety of different lengths. In some examples, the second textile layer 1012 can include a length the covers the shank 228 and that terminates near or slightly above the top edge of the shank. In some examples, the second textile layer 1012 can include a length configured to extend along the strap of the support garment, from the front portion and towards the back.

Figure 10E:
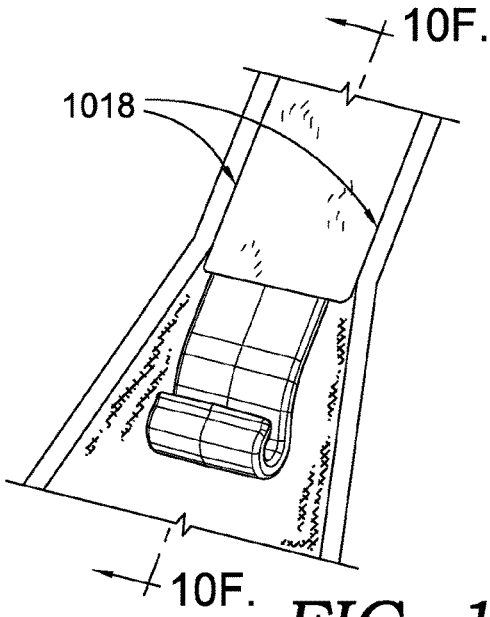

In at least some examples, as illustrated in FIG. 10E, an edge binder 1018 (e.g., seamed textile layer, seam tape, etc.) can be coupled along the edges of the textiles 1010 and 1012 to help finish the edges and to help hold the assembly together.

Figure 10F:
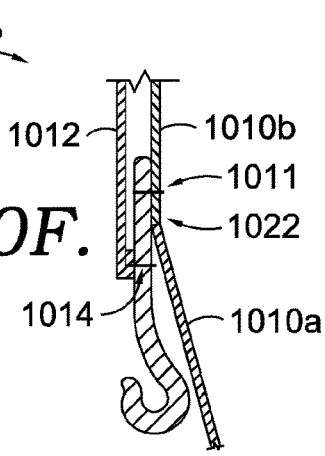

Referring to FIG. 10F, a cross-section of the hook and strap assembly 1020 is illustrated. The assembly 1020 can include various elements. In some examples, the assembly 1020 can include the first textile layer 1010, the second textile layer 1012, and the hook 220. In addition, at least a portion of the hook 220 can be positioned between the first textile layer 1010 and the second textile layer 1012. For example, an upper portion of the shank 228 can be positioned between the first textile layer 1010 and the second textile layer 1012.

In addition, the assembly 1020 can include various fasteners, such as a fastener (e.g., stitches along a seam) between the panels 1010*a* and 1010*b*, a fastener 1011 (e.g., stitches) between the shank 228 and the first textile layer 1010, and a fastener 1014 (e.g., stitches) between the shank 228 and the second textile layer 1012.

In some examples, one or more fasteners (e.g., stitches) are exposed on the inner face of the assembly 1020, such as the fastener 1022 attaching the panels 1010*a* and 1010*b* and/or the fastener 1011 attaching the hook 220 to the first textile layer 1010. In at least some instances, the second layer 1012 can obscure or hide the fastener 1014 from being visible on the outer face of the assembly 1020. For example, the second layer 1012 can include the fold 1013 that permits the second layer 1012 to extend over the fastener 1014 and hide the fastener 1014 from view.

As explained above, the layers 1010 and 1012 can include a variety of different textiles in various combinations and configured to perform respective functions. For instance, where the panel 1010*b* is configured to form a portion of a shoulder strap, the panel 1010*b* can include one or more padding layers (e.g., foam padding) for comfort, as well as a soft and elastic innermost layer (e.g., elastic knit). This is one example, and the textiles of the assembly 1020 can include any combination of textiles described in this disclosure.

In some instances, it can be desirable to create a more seamless inner face (e.g., as compared to the assembly 1020), and FIGS. 11A to 11F illustrates steps for constructing an assembly 1120 that can have fewer exposed seems on the inner face (e.g., as compared to the assembly 1020). For example, in FIG. 11A, the hook 220 can be positioned adjacent to a first textile layer 1110 of an article (e.g., a wearable article, bag, etc.). In some examples, the first textile layer 1110 can include a base layer of a strap for a support garment (e.g., at least a portion of strap 116/118 of the support garment 110), and the base layer can include a textile layer positioned between the hook 220 and the wearer. That is, the textile layer 1110 can be positioned internal or inner relative to the hook 220. The textile layer 1110 can include any of the material properties described with respect to the textile layer (e.g., including the textile panels 1110*a* and 1110*b*), and for brevity the disclosure is not again repeated here in association with FIG. 11.

Figure 11A:
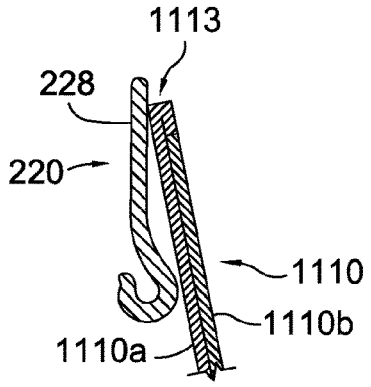
FIGS. 11A to 11F depict various steps of another method of attaching a hook to an apparel article and a resulting construction, in accordance with examples of this disclosure.
Figure 11B:
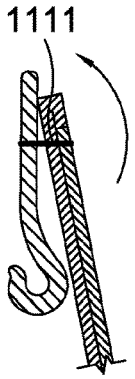
Figure 11C:
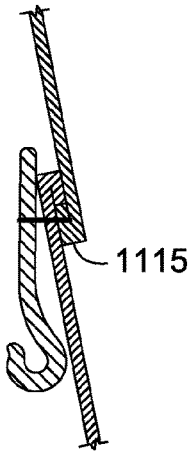
Figure 11D:
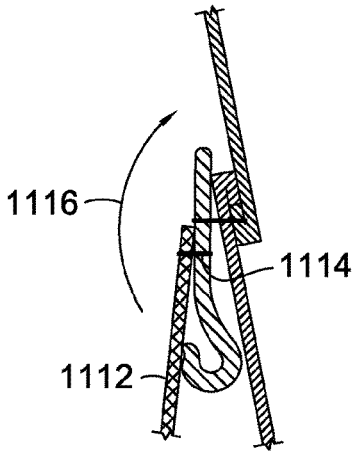
Figure 11E:
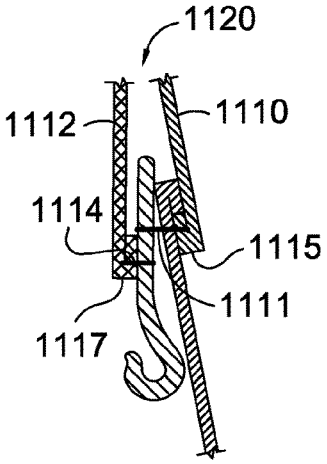

In some examples, as illustrated in FIG. 11B, the first textile layer 1110 is arranged, such that a fastener or coupling attaching the hook 220 to the first textile layer 1110 is hidden. For example, via a fold 1113 the textile layer 1110 can be folded over, onto itself, such that the textile layer 1110 includes an inner portion that is closer to the hook 220 and an outer portion that is farther from the hook 220 (e.g., where the inner portion is between the hook 220 and the outer portion). In at least some instances, as illustrated in FIG. 11C, the hook 220 is coupled to the first layer 1110. For example, a fastener 1111, such stitches, can be affixed through the shank 228 and through the inner portion of the first layer 1110 and through the outer portion of the first layer 1110. At some point, the outer portion of the first layer 1110 can be folded over the fastener 1111 (e.g., via the fold 1115) to hide the fastener 1111.

In at least some examples, a second textile layer 1112 can be integrated in a manner similar to the second textile layer 1012. For example, the second textile layer 1112 can positioned on the side of the hook 220 that is opposite the first textile layer 1110. The second textile layer 1112 can include various properties similar to the second textile layer 1012.

The second textile layer 1112 can be coupled to the hook 220. For example, a fastener 1114, such as stitches, can be affixed through the shank 228 and the second textile layer 1112, and other fasteners are also contemplated, such as rivets, adhesive bonding, etc. In some examples, the fastener may not extend through the first textile layer 1110. In other examples, the fastener can extend through the first textile layer 1110. The second textile layer 1112 can be moved (e.g., folded) to cover the fastener 1114, such as indicated by the arrow 1116, and illustrated by FIGS. 11D and 11E. In such cases the second textile layer 1112 can overlap with at least a portion of the textile panel 1110.

Figure 11F:
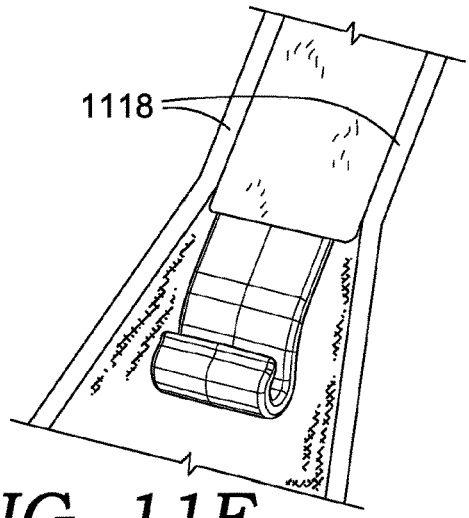

In at least some examples, an edge binder 1118 (e.g., seamed textile layer, seam tape, etc.) can be coupled along the edges of the textiles 1110 and 1112 to help finish the edges and to help hold the assembly together, as illustrated in FIG. 11F.

In FIG. 11, a cross-section of the hook and strap assembly 1120 is illustrated. The assembly 1120 can include various elements. In some examples, the assembly 1120 can include the first textile layer 1110, the second textile layer 1112, and the hook 220. In addition, at least a portion of the hook 220 can be positioned between the first textile layer 1110 and the second textile layer 1112. For example, an upper portion of the shank 228 can be positioned between the first textile layer 1110 and the second textile layer 1112.

In addition, the assembly 1120 can include various fasteners, such as a fastener (e.g., stitches along a seam) between the panels 1110*a* and 1110*b* (e.g., if there are separate panels); a fastener 1111 (e.g., stitches) between the shank 228 and the first textile layer 1110; and a fastener 1114 (e.g., stitches) between the shank 228 and the second textile layer 1112. In at least some examples, the fasteners are hidden from view, such as via the folds 1115 and 1117.

Figure 12B:
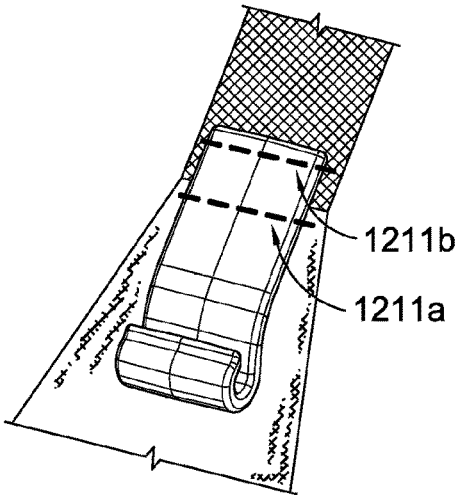

In the assemblies 1020 and 1120, a portion of the shank 228 might be exposed below the fastener 1014 and 1114, respectively. In some instances, it can be desirable to hide more of the shank 228 (as compared to the assemblies 1020 and 1120). Referring to FIGS. 12A to 12E, in some examples, as illustrated in FIG. 12A, the hook 220 can be coupled to a first textile layer 1210, which can be similar to the first layer 1010 or the first layer 1110. For example, one or more fasteners 1211*a* and/or 1211*b*, such as stitches, can be attached to the shank 228 and to the first textile layer 1210, as illustrated in FIG. 12B.

Figure 12C:
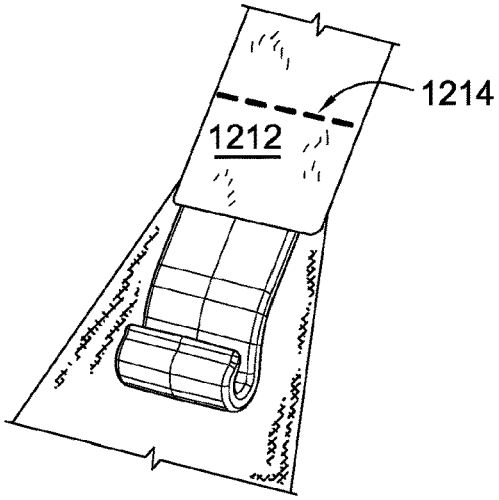
Figure 12D:
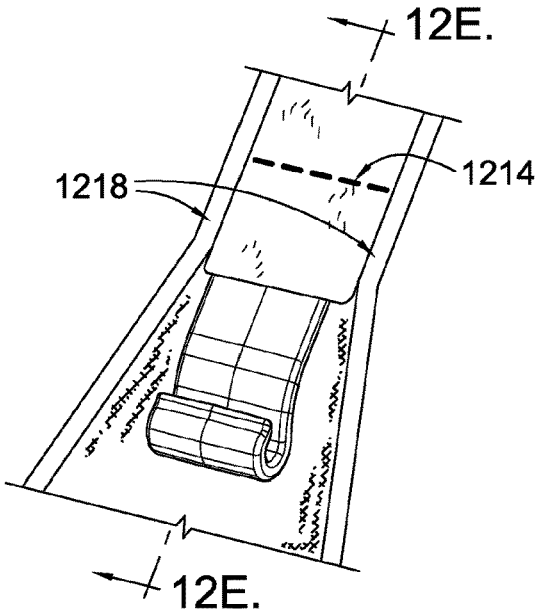
Figure 12E:
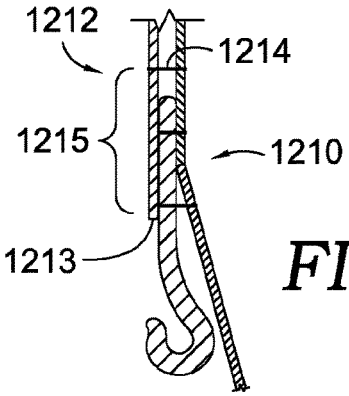

In addition, as illustrated in FIG. 12C, a second textile layer 1212 can be positioned on the side of the shank 228 opposite the first textile layer 1210, such that the shank 228 is positioned between the layers 1210 and 1212. The second textile layer 1212 can be coupled to the first textile layer 1210, to the hook 220 (e.g., to the shank 228), or to both the first textile layer 1210 and to the hook 220. For example, a fastener 1214, such as stitches, can be coupled through the second textile layer 1212 and the first textile layer 1210, and other fasteners are also contemplated, such as rivets, adhesive bonding, etc. In some examples, the fastener 1214 is positioned above, and is spaced apart from, the top edge of the shank 228, such that the fastener attaches the two textile layers 1210 and 1212, and anchors the second textile layer 1212 in position relative to the hook 220 (and the shank 228, without also extending through the hook 220 or the shank 228. An example of the fastener 1214 spaced apart from the top edge of the shank 228 can be seen in FIG. 12E. In other examples (not illustrated), the fastener 1214 and/or one or more other fasteners (e.g., stitch or adhesive) can affix the shank 228 directly to the second textile layer 1212.

In at least some examples, the second textile layer 1212 can include a terminal end 1213 and portion 1215 that extends between the fastener 1214 and the terminal end, and the portion 1215 can cover a portion of the shank 228. That is, a portion of the shank 228 can be positioned between the portion 1215 and the first textile layer 1210. In addition, the portion 1215 can cover the fastener 1211*a* and/or the fastener 1211*b*, which can protect the fastener (e.g., from wear and abrasion) and can provide a cleaner aesthetic.

In at least some examples, as illustrated by FIG. 12 D, an edge binder 1218 (e.g., seamed textile layer, seam tape, etc.) can be coupled along the edges of the textiles 1210 and 1212 to help finish the edges and to help hold the assembly together.

In at least one example, FIGS. 13A to 13D illustrates another series of operations associated with a hook and strap assembly 1320. For example, in FIG. 13A, the hook 220 can be coupled to a first textile layer 1310, which can be similar to the first layer 1010 or the first layer 1110. In examples, one or more fasteners 1311*a* and/or 1311*b*, such as stitches, can be attached to the shank 228 and to the first textile layer 1310.

In addition, a slit or opening 1313 can be formed in a second textile layer 1312, and a trim piece 1314 can be secured around the slit or opening 1313.

Figure 13A:
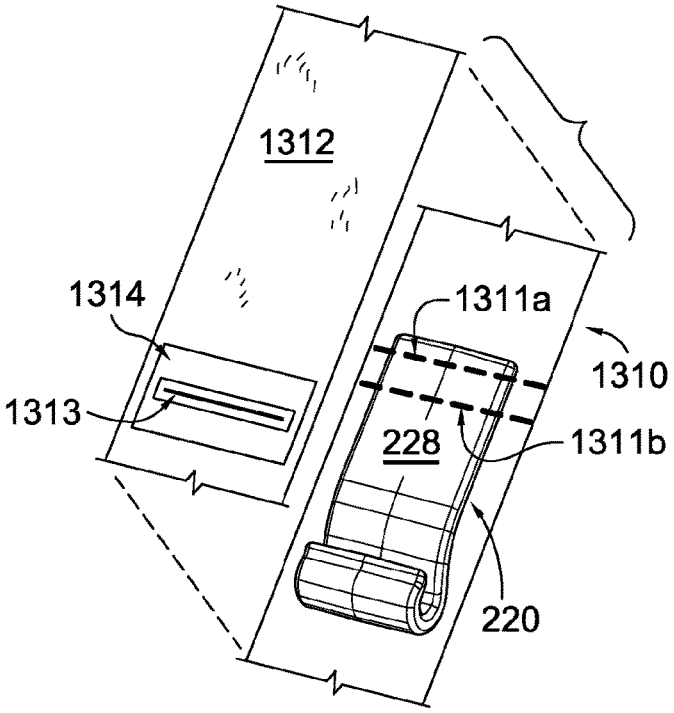
Figure 13B:
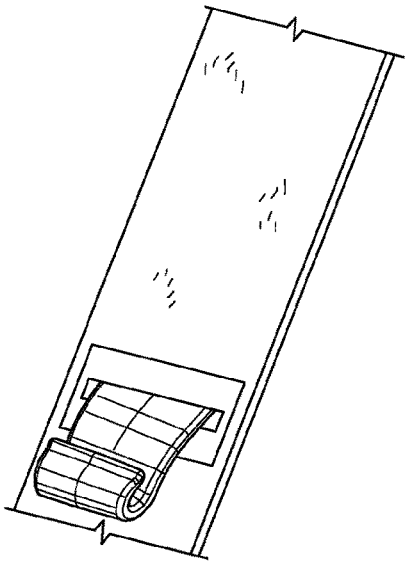
Figure 13C:
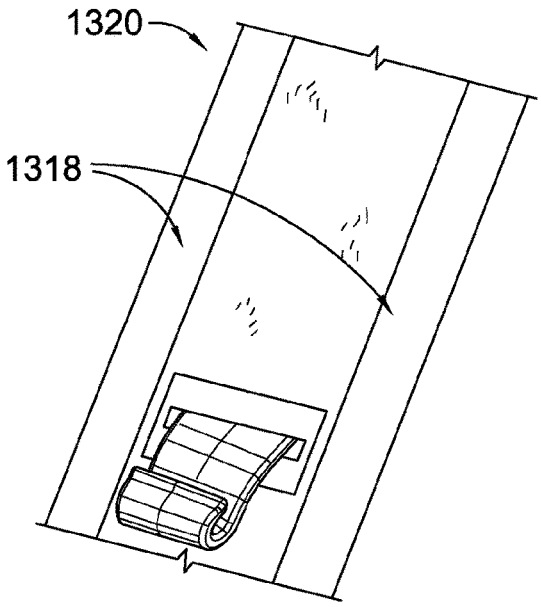

Moving on to FIG. 13B, the hook 220 that is secured to the first textile layer 1310 can be inserted through the slit or opening 1313, while the shank 228 is positioned between the first textile layer 1310 and the second textile layer 1312. In some examples the first textile layer 1310 can be coupled to the second textile layer 1312, such as by stitches, adhesive, and the like. In at least some examples, as depicted by FIG. 13C, an edge binder 1318 (e.g., seamed textile layer, seam tape, etc.) can be coupled along the edges of the textiles 1310 and 1312 to help finish the edges and to help hold the assembly together.

Figure 13D:
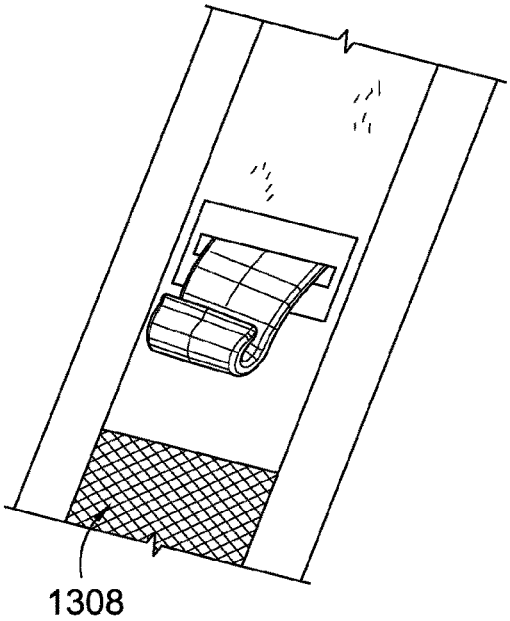

In at least some examples, as illustrated in FIG. 13D, the assembly 1320 of the first textile layer 1310 and the second textile layer 1312 can be coupled to one or more other textile layers 1308 that form other parts of a wearable article. For example, the assembly 1320 can comprise a portion of a strap of a support garment and the textile layer 1308 can comprises another portion of a front of the support garment (e.g., 126 in FIG. 1A).

EXAMPLE CLAUSES

Clause 1: A support garment comprising: a first textile portion and a second textile portion; a fastener for releasably connecting the first textile portion to the second textile portion, the fastener comprising a receiver that is connected to the first textile portion and a hook that is connected to the second textile portion; a length of the first portion being slidably adjustable relative to the receiver; the receiver comprising a slot for receiving a portion of the hook and an anchor bar for fitting with the hook, the anchor bar comprising a side of the slot; the slot comprising a first width that is farther away from anchor bar and a second width that is closer to the anchor bar, the second width being smaller than the first width; the anchor bar comprising, in a transverse cross section, a third width; and the hook comprising: a bend comprising hook throat and a gape providing a passageway to the hook throat; and the hook throat comprising a fourth width that is greater than the third width and the gape comprising a fifth width that is less than the third width.

Clause 2. The support garment of Clause 1, wherein: the first textile portion comprises a strap that is coupled to a breast-covering portion of the support garment and that is slidably coupled to the receiver; and the second textile portion is coupled to a shoulder strap of the support garment.

Clause 3. The support garment of Clause 1 or 2, wherein: the receiver comprises an inner side configured to face towards the support garment when the fastener is connected; and the inner side comprises a standoff portion protruding outward from the inner side.

Clause 4. The support garment of Clause 3, further comprising a second standoff portion, wherein: the receiver comprises a channel between the standoff portion and the second standoff portion; and the channel receives at least a portion of the first textile portion.

Clause 5. The support garment any of Clauses 1 to 4, wherein: the hook comprises a shank coupled to the second textile portion; the shank comprises an inner side configured to face towards the support garment; and a midpoint of the hook throat is at least even with the inner side of the shank or is more inward, as compared with the inner side of the shank.

Clause 6. The support garment of any of Clauses 1 to 5, wherein: the receiver comprises a first material; the hook comprises a second material; the first material and the second material include different material properties; and the second material is more elastic than the first material.

Clause 7. The support garment of any of Clauses 1 to 6, wherein: the receiver and the hook comprise a same material; and a thickness of the bend is configured to enable the bend to elastically flex when the anchor bar passes through the gape.

Clause 8. A fastener comprising: a receiver that releasably connects to a hook; the receiver comprising a slot for receiving a portion of the hook and an anchor bar for fitting with the hook, the anchor bar comprising a side of the slot; the slot comprising a first width that is farther away from anchor bar and a second width that is closer to the anchor bar, the second width being smaller than the first width; and the hook comprising: a bend comprising hook throat and an ungated gape providing a passageway to the hook throat; and the hook throat configured to permit the anchor bar to rotate relative to the hook.

Clause 9. The fastener of Clause 8, wherein: the hook comprises a broad, flat shank that is attached to the bend and that is configured to be affixed to a shoulder strap of a support garment.

Clause 10. The fastener of Clause 8 or 9, wherein the second width of the of the slot is about 1% to about 5% larger than a width associated with the hook.

Clause 11. The fastener of any of Clauses 8 to 10, wherein: the anchor bar is a first cross bar; and the receiver comprises a second cross bar for slidably connecting to a strap.

Clause 12. The fastener of Clause 11, further comprising: a first standoff portion and a second standoff portion, the first standoff portion and the second standoff portion comprising sides of a channel, which is configured to receive at least a segment of the strap.

Clause 13. The fastener of any of Clauses 8 to 12, wherein the receiver comprises one or more standoff portions configured to space the receiver apart from an underlying surface.

Clause 14. The fastener of any of Clauses 8 to 13, wherein: the receiver is coupled to a first portion of an article and the hook is coupled to a second portion of the article; the receiver and the hook are configured to releasably connect the first portion to the second portion; and the article is a support garment, a belt, a footwear article, or a backpack.

Clause 15. A fastener comprising: a receiver that releasably connects to a hook; the receiver comprising a slot for receiving a portion of the hook and an anchor bar for fitting with the hook, the anchor bar comprising a side of the slot; the slot comprising a first width that is farther away from anchor bar and a second width that is closer to the anchor bar, the second width being smaller than the first width; and the hook comprising a bend that, when connecting to the anchor bar, interference fits with the anchor bar, and when connected to the anchor bar, comprises a clearance fit and/or a transition fit.

Clause 16. The fastener of Clause 15, wherein the bend comprises: a hook throat and a gape providing a passageway to the hook throat; and the gape comprises a gape width that is smaller than a width of the anchor bar.

Clause 17. The fastener of Clause 16, wherein the bend comprises a portion that generally opposes the gape on an opposite side of the throat and that is configured to elastically open the bend when the anchor bar is moved through the passageway.

Clause 18. The fastener of any of Clauses 15 to 17, wherein the anchor bar comprises a straight, elongated body comprising, in a longitudinal orientation, an anchor-bar length and, in a transverse orientation, an anchor-bar width.

Clause 19. The fastener of Clause 18, wherein the anchor-bar length is about 4.5× to 5.5× larger than the anchor-bar width.

Clause 20. The fastener of Clause 19, wherein the anchor bar length is about 1% to about 5% larger than a hook width.

Clause 21. The fastener of any of Clauses 15 to 20, wherein the receiver further comprises: a first side and a second side, which is opposite the first side; a strap-adjustment bar extending from the first side to the second side and configured to slidably engage a textile portion; and a first standoff portion and a second standoff portion, the first standoff portion and the second standoff portion comprising sides of a channel, which is configured to receive at least a segment of the textile portion.

Clause 22. The fastener of any of Clauses 1 to 21, wherein the hook comprises a shank that attaches between a first textile layer and a second textile layer.

Clause 23. The fastener of Clause 23, wherein the first textile layer comprises a strap of a support garment.

Clause 24. The fastener of Clause 23, wherein the first textile layer comprises one or more textile layers.

Clause 25. The fastener of Clause 24, wherein the one or more textile layers comprise at least one padding textile layer.

Clause 26. The fastener of Clause 25, wherein the at least one padding textile layer comprises a foam padding layer.

Clause 27. The fastener of any of Clauses 22 to 26, wherein the shank is coupled by a first fastener directly to the first textile layer.

Clause 28. The fastener of Clause 27, wherein the first textile layer includes a folded portion that obscures the first fastener, such that the first fastener is positioned between the shank and the folded portion.

Clause 29. The fastener of any of Clauses 22 to 28, wherein the shank is coupled by a second fastener directly to the second textile layer.

Clause 30. The fastener of Clause 29, wherein the second textile layer comprises a folded portion that obscures the second fastener, such that the second fastener is positioned between the shank and the folded portion of the second textile layer.

Clause 31. The fastener of any of Clauses 22 to 30, wherein the second textile layer is affixed by a third fastener directly to the first textile layer.

Clause 32. The fastener of any of Clauses 22 to 31, wherein the first textile layer comprises an innermost surface of a shoulder strap for a support garment.

Clause 33. The fastener of any of Clauses 22 to 32, wherein the second textile layer comprises an outermost surface of a shoulder strap for a support garment.

As used herein, a recitation of "and/or" with respect to two or more elements should be interpreted to mean only one element, or a combination of elements. For example, "element A, element B, and/or element C" may include only element A, only element B, only element C, element A and element B, element A and element C, element B and element C, or elements A, B, and C. In addition, "at least one of element A or element B" may include at least one of element A, at least one of element B, or at least one of element A and at least one of element B. Further, "at least one of element A and element B" may include at least one of element A, at least one of element B, or at least one of element A and at least one of element B.

This detailed description is provided in order to meet statutory requirements. However, this description is not intended to limit the scope of the invention described herein. Rather, the claimed subject matter may be embodied in different ways, to include different steps, different combinations of steps, different elements, and/or different combinations of elements, similar or equivalent to those described in this disclosure, and in conjunction with other present or future technologies. The examples herein are intended in all respects to be illustrative rather than restrictive. In this sense, alternative examples or implementations can become apparent to those of ordinary skill in the art to which the present subject matter pertains without departing from the scope hereof.

The invention claimed is:

1. A support garment comprising:

a first textile portion and a second textile portion;

a fastener for releasably connecting the first textile portion to the second textile portion, the fastener comprising a receiver that is connected to the first textile portion and a hook that is connected to the second textile portion;

a length of the first portion being slidably adjustable relative to the receiver;

the receiver comprising a slot for receiving a portion of the hook and an anchor bar for fitting with the hook, the anchor bar comprising a side of the slot;

the slot comprising a first width that is farther away from anchor bar and a second width that is closer to the anchor bar, the second width being smaller than the first width;

the anchor bar comprising, in a transverse cross section, a third width; and the hook comprising:

a bend comprising hook throat and a gape providing a passageway to the hook throat; and the hook throat comprising a fourth width that is greater than the third width and the gape comprising a fifth width that is less than the third width.

2. The support garment of claim 1, wherein:

the first textile portion comprises a strap that is coupled to a breast-covering portion of the support garment and that is slidably coupled to the receiver; and the second textile portion is coupled to a shoulder strap of the support garment.

3. The support garment of claim 1, wherein:

the receiver comprises an inner side configured to face towards the support garment when the fastener is connected; and the inner side comprises a standoff portion protruding outward from the inner side.

4. The support garment of claim 3, further comprising a second standoff portion, wherein:

the receiver comprises a channel between the standoff portion and the second standoff portion; and the channel receives at least a portion of the first textile portion.

5. The support garment of claim 1, wherein:

the hook comprises a shank coupled to the second textile portion;

the shank comprises an inner side configured to face towards the support garment; and a midpoint of the hook throat is at least even with the inner side of the shank or is more inward, as compared with the inner side of the shank.

6. The support garment of claim 1, wherein:

the receiver comprises a first material;

the hook comprises a second material;

the first material and the second material include different material properties; and the second material is more elastic than the first material.

7. The support garment of claim 1, wherein:

the receiver and the hook comprise a same material; and a thickness of the bend is configured to enable the bend to elastically flex when the anchor bar passes through the gape.

* * * * *